US007732113B2

(12) United States Patent
Nakamura et al.

(10) Patent No.: US 7,732,113 B2
(45) Date of Patent: Jun. 8, 2010

(54) ELECTROPHOTOGRAPHIC PHOTOSENSITIVE MEMBER, PROCESS CARTRIDGE AND ELECTROPHOTOGRAPHIC APPARATUS, AND PROCESS FOR PRODUCING ELECTROPHOTOGRAPHIC PHOTOSENSITIVE MEMBER

(75) Inventors: Kazushige Nakamura, Yokohama (JP); Hidetoshi Hirano, Suntoh-gun (JP); Hirotoshi Uesugi, Numazu (JP); Hirofumi Kumoi, Suntoh-gun (JP); Shinji Takagi, Mishima (JP); Yukihiro Abe, Mishima (JP); Junpei Kuno, Numazu (JP); Daisuke Miura, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 513 days.

(21) Appl. No.: 11/720,580

(22) PCT Filed: Mar. 24, 2006

(86) PCT No.: PCT/JP2006/306782

§ 371 (c)(1),
(2), (4) Date: May 31, 2007

(87) PCT Pub. No.: WO2006/104225

PCT Pub. Date: Oct. 5, 2006

(65) Prior Publication Data

US 2009/0136256 A1 May 28, 2009

(30) Foreign Application Priority Data

Mar. 28, 2005 (JP) ..... 2005-091564
Jul. 11, 2005 (JP) ..... 2005-201857

(51) Int. Cl.
*G03G 5/14* (2006.01)

(52) U.S. Cl. ..... 430/63; 430/131; 399/159; 399/174

(58) Field of Classification Search ..... 430/62, 430/63, 131, 60; 399/159, 174
See application file for complete search history.

(56) References Cited

U.S. PATENT DOCUMENTS 4,416,963 A * 11/1983 Takimoto et al. ..... 430/69
5,455,135 A 10/1995 Maruyama et al.
5,488,461 A 1/1996 Go et al.
5,693,443 A 12/1997 Nakamura et al. ..... 430/66
6,215,971 B1 * 4/2001 Sakoh et al. ..... 399/159
6,400,919 B1 * 6/2002 Inoue et al. ..... 399/176
7,171,141 B2 1/2007 Abe et al. ..... 399/176
2004/0197115 A1 10/2004 Abe et al. ..... 399/176
2005/0058926 A1 3/2005 Kawakami et al. ..... 430/108.7

FOREIGN PATENT DOCUMENTS

| | | | |
|---|---|---|---|
| JP | 04-154621 | | 5/1992 |
| JP | 05-341620 | | 12/1993 |
| JP | 06-208238 | | 7/1994 |
| JP | 08-286468 | | 11/1996 |
| JP | 10-186702 | | 7/1998 |
| JP | 2000-206730 | | 7/2000 |
| JP | 2001-109181 | | 4/2001 |
| JP | 2003-015349 | | 1/2003 |
| JP | 2003-277054 | | 10/2003 |
| JP | 2004-038056 | | 2/2004 |
| JP | 2004-061640 | | 2/2004 |
| JP | 2004-309911 | | 11/2004 |
| JP | 2004-326099 | | 11/2004 |
| JP | 2005-107177 | * | 4/2005 |
| JP | 2005-156988 | | 6/2005 |
| JP | 2005-316226 | | 11/2005 |
| JP | 2005-338750 | | 12/2005 |

OTHER PUBLICATIONS

Japanese Patent Office machine-assisted translation of JP 2005-107177 (pub. Apr. 2005).*
Drawings 1 to 3 in the Japanese Patent Office machine-assisted translation of JP 07-295245 (pub. Nov. 1995).*
Japanese Patent Office mach. translation of JP 07-295245(pub. Nov. 1995).

* cited by examiner

*Primary Examiner*—Janis L Dote
(74) *Attorney, Agent, or Firm*—Fitzpatrick, Cella, Harper & Scinto

(57) ABSTRACT

In an electrophotographic photosensitive member having a support, a conductive layer formed on the support, an intermediate layer formed on the conductive layer, and a photosensitive layer formed on the intermediate layer, the conductive layer has been formed by using a conductive layer coating fluid which contains $TiO_2$ particles coated with oxygen deficient $SnO_2$ having an average particle diameter of from 0.20 μm or more to 0.60 μm or less, and has a volume resistivity of from more than $8.0\times10^8$ Ωcm to $1.0\times10^{11}$ Ωcm or less. The electrophotographic photosensitive member can keep charging lines from occurring.

19 Claims, 2 Drawing Sheets

ELECTROPHOTOGRAPHIC PHOTOSENSITIVE MEMBER, PROCESS CARTRIDGE AND ELECTROPHOTOGRAPHIC APPARATUS, AND PROCESS FOR PRODUCING ELECTROPHOTOGRAPHIC PHOTOSENSITIVE MEMBER

TECHNICAL FIELD

This invention relates to an electrophotographic photosensitive member, a process cartridge and an electrophotographic apparatus which have the electrophotographic photosensitive member, and also to a process for producing the electrophotographic photosensitive member.

TECHNICAL BACKGROUND

In recent years, research and development are energetically made on electrophotographic photosensitive members making use of organic photoconductive materials (i.e., organic electrophotographic photosensitive members).

The electrophotographic photosensitive members are each basically constituted of a support and a photosensitive layer formed on the support. Under existing circumstances, however, various layers are often formed between the support and the photosensitive layer in order to, e.g., cover defects on the support surface, improve coating performance for the photosensitive layer, improve the adhesiveness between the support and the photosensitive layer, protect the photosensitive layer from electrical breakdown, improve chargeability, and improve the performance of blocking the injection of electric charges from the support to the photosensitive layer. Thus, the layers to be formed between the support and the photosensitive layer are required to have many functions such as covering properties, adhesiveness, mechanical strength, conductivity, electrical barrier properties, and so forth.

The layers to be provided between the support and the photosensitive layer are conventionally known to include the following types.

(i) A resin layer containing no conductive material.

(ii) A resin layer containing a conductive material.

(iii) A multi-layer formed by superposing the type-(i) layer on the type-(ii) layer.

The type-(i) layer contains no conductive material, and hence the layer has a high resistivity. Moreover, in order to cover defects on the support surface having not been subjected to surface smoothing treatment, it must be formed in a large thickness (layer thickness).

However, if such a type-(i) layer having a high resistivity is formed in a large layer thickness, a problem may arise such that it brings about a high residual potential at the initial stage and during repeated use.

Accordingly, in order for the type-(i) layer to be put into practical use, it is necessary to lessen defects on the support surface and also to form the layer in a small layer thickness.

On the other hand, the type-(ii) layer is a layer in which a conductive material such as conductive particles are dispersed in a resin, and the layer can be made to have a low resistivity. Hence, the layer may be formed in a large layer thickness so as to cover defects on the surface of a conductive support or a non-conductive support (such as a support made of a resin).

However, where the type-(ii) layer is formed in a large layer thickness, the layer must be endowed with a sufficient conductivity, compared with the type-(i) layer to be formed in a small thickness, and hence the type-(ii) layer results in a layer having a low volume resistivity. Hence, in order to block the injection of electric charges from the support and the type-(ii) layer into the photosensitive layer, which is causative of image defects, under environmental conditions ranging broadly from low temperature and low humidity to high temperature and high humidity, it is preferable that a layer having electrical barrier properties is additionally provided between the type-(ii) layer and the photosensitive layer. Such a layer having electrical barrier properties is a resin layer containing no conductive material, such as the type-(i) layer.

That is, the layer to be provided between the support and the photosensitive layer may preferably have the type-(iii) constitution in which the type-(i) layer and the type-(ii) layer are superimposed one on another.

The type-(iii) constitution requires formation of a plurality of layers, and hence requires steps in a correspondingly larger number. However, it has such an advantage that the tolerance for defects on the support surface can be of a wide range, and hence the tolerance for the use of the support can be of a vastly wide range, promising the achievement of improvement in productivity.

In general, the type-(ii) layer is called a conductive layer and the type-(i) layer is called an intermediate layer (a subbing layer or a barrier layer).

An aluminum pipe produced by a production process having an extrusion step and a drawing step and an aluminum pipe produced by a production process having an extrusion step and an ironing step are used as supports for electrophotographic photosensitive members, which can achieve a good dimensional precision and surface smoothness as non-cut pipes without requiring surface cutting and besides are advantageous in view of cost as well. However, burr-like protruding defects tend to occur on the surfaces of these aluminum non-cut pipes. Thus, from the viewpoint of covering surface defects of such supports, too, the type-(iii) constitution is preferred.

As the conductive material used in the conductive layer, it includes various metals, metal oxides and conductive polymers. In particular, tin oxide (hereinafter also "$SnO_2$") having powder resistivity usually in the range of from $10^4$ to $10^6$ Ωcm is preferred as having superior resistivity characteristics. A conductive material is also available whose powder resistivity is reduced to 1/1,000 to 1/100,000 by mixing (or doping), when the $SnO_2$ conductive material is produced, a compound of a metal having a valence different from tin, such as antimony oxide, or a non-metallic element. An oxygen deficient $SnO_2$ conductive material is also available in which the resistivity of $SnO_2$ has been made to be as small as that of antimony doped materials without adding constituent elements and in a non-doped state.

As prior art relating to oxygen deficient $SnO_2$, Japanese Patent Application Laid-open No. H07-295245 for example discloses a technique making use of oxygen deficient $SnO_2$ in a conductive layer. Japanese Patent Application Laid-open No. H06-208238 also discloses a technique in which barium sulfate particles are coated with oxygen deficient $SnO_2$ so that dispersibility can be further improved than that in a case in which only $SnO_2$ is used. Japanese Patent Application Laid-open No. H10-186702 still also discloses a technique in which barium sulfate particles are used in order to improve dispersibility, the particles being coated with titanium oxide ($TiO_2$) in order to improve whiteness and further coated with $SnO_2$ in order to provide conductivity. This Japanese Patent Application Laid-open No. H10-186702, however, does not disclose any embodiments of the oxygen deficient $SnO_2$.

In recent years, an electrophotographic apparatus has become widely used employing a contact charging system in which a voltage is applied to a charging member provided in contact with an electrophotographic photosensitive member (i.e., a contact charging member), to charge the electrophotographic photosensitive member. In particular, a system is prevalent in which a roller-shaped contact charging member (a charging roller) is brought into contact with the surface of an electrophotographic photosensitive member, and a voltage generated by superimposing an alternating-current voltage on a direct-current voltage is applied thereto to charge the electrophotographic photosensitive member (an AC/DC contact charging system), or in which only a direct-current voltage is applied to the charging member to charge the electrophotographic photosensitive member (a DC contact charging system).

In the AC/DC contact charging system, there are disadvantages, e.g., such that a direct-current power source and an alternating-current power source are required to bring about a rise in cost of the electrophotographic apparatus itself and that the size of electrophotographic apparatus becomes enlarged as compared with the case of the DC contact charging system. In addition, there is such a disadvantage that alternating current consumed in a large quantity causes deterioration in durability of the contact charging member and electrophotographic apparatus.

Accordingly, taking into account cost reduction, compactness and high durability, the DC contact charging system can be said to be more preferred.

However, electrophotographic apparatus employing the DC contact charging system tend to become inferior in the uniformity of the surface potential of the electrophotographic photosensitive member at the time of charging (i.e., charging uniformity) to electrophotographic apparatus employing the AC/DC contact charging system. Accordingly, faulty images caused by non-uniform charging and appearing in non-uniform lines in the lengthwise direction (the direction perpendicular to the peripheral direction) of the electrophotographic photosensitive member (hereinafter also "charging lines") are apt to bring about a problem in halftone images or the like.

In regard to such a problem, a proposal for improvement has been made in respect of the charging member. Specifically, as a measure for improving charging uniformity, studies are made on how to make the resistance distribution of the charging member uniform and improve the surface properties of the charging member.

As to the former, measures are available in which, e.g., the dispersion of a conductive material in a surface layer (outermost layer) of the charging member is improved, a resin having a relatively low volume resistivity is used in a binding material of a surface layer of the contact charging member, and the layer thickness of each layer constituting the contact charging member is adjusted to be uniform.

As to the latter, measures are available in which, e.g., a leveling agent is added to a surface layer of the charging member, and an elastic layer of the charging member is improved in surface properties.

In the case where only a direct-current voltage is applied to the charging member to charge the electrophotographic photosensitive member, Japanese Patent Application Laid-open No. H05-341620 proposes a technique in which the surface roughness of the charging member is made to be 5 μm or less to achieve the charging uniformity.

Japanese Patent Application Laid-open No. H08-286468 proposes a technique in which that the ten-point average roughness Rz jis (JIS B 0601) of the charging member surface is made to be 20 μm or less in order for the charging uniformity to be secured to provide good images.

According to the above proposals, the improvement of initial-stage charging uniformity can be substantially achieved, but under existing circumstances, is insufficient in respect of stabilizing the charging uniformity. More specifically, as a result of long-term service, contaminant such as developer dust or paper dust adheres to the surface of the charging member. In that case, where they come to adhere partially non-uniformly or adhere in a large quantity, they may lower the charging uniformity.

For the subject of stabilizing the charging uniformity during long-term service, proposals are made in which the surface roughness is further adjusted to make improvement. For example, in Japanese Patent Applications Laid-open No. 2004-061640 and No. 2004-309911, a technique is disclosed in which the surface roughness of the charging member is controlled to secure the charging uniformity. Also, in Japanese Patent Applications Laid-open No. 2004-038056, a technique is disclosed in which the surface roughness of the charging member and the coefficient of surface friction of the electrophotographic photosensitive member are controlled to secure the charging uniformity.

In general, it is known that contaminant can be better kept from adhering to the surface of the charging member as a result of long-term service as the charging member has a smaller surface roughness. Also, if it has too large surface roughness, faulty images such as spots may come about because of faulty charging due to the surface shape of the charging member. From these viewpoints, it is more preferable for the charging member to have a smaller surface roughness.

Electrophotographic apparatus are more highly demanded to achieve higher speed and higher image quality. In particular, as images have come to be reproduced in colors (in full color), halftone images and solid images have come to be often reproduced, and such a demand for higher image quality increases steadily year by year.

For example, importance is attached to the uniformity of density and tint in reproduced images on each sheet and the stability in continuous image reproduction, and tolerance therefore have become remarkably severer as compared with that in black-and-white printers and black-and-white copying machines. In particular, in electrophotographic apparatus employing the DC contact charging system, records in one cycle of electrophotographic processing tends to appear as charge potential non-uniformity of the electrophotographic photosensitive member, which may cause ghost due to records of exposure (image exposure) and charge memory due to transfer (transfer memory). Then, as a result, density non-uniformity may come about in reproduced images.

Accordingly, in usual cases, a measure is applied in which a charge elimination (de-charging) means such as a pre-exposure means is provided on the downstream side of a transfer means and on the upstream side of a charging means so as to eliminate records in one cycle of electrophotographic processing and eliminate the non-uniformity of surface potential of the electrophotographic photosensitive member.

DISCLOSURE OF THE INVENTION

However, as a result of studies made by the present inventors, it has turned out that the charging lines tend to greatly occur when the electrophotographic photosensitive member employing the type-(iii) constitution between the support and the photosensitive layer is used in an electrophotographic apparatus having such a pre-exposure means. In addition, it has turned out that the charging lines occur more conspicuously in a low-temperature and low-humidity environment and also in the case where cycle time is short.

An object of the present invention is to provide an electrophotographic photosensitive member in which it is difficult for the charging lines to occur even when employing the type-(iii) constitution between the support and the photosensitive layer.

Another object of the present invention is to provide a process cartridge and an electrophotographic apparatus which have such an electrophotographic photosensitive member.

Still another object of the present invention is to provide a process for producing such an electrophotographic photosensitive member.

The present invention is an electrophotographic photosensitive member having a support, a conductive layer formed on the support, an intermediate layer formed on the conductive layer, and a photosensitive layer formed on the intermediate layer, wherein;

The conductive layer is a layer formed by using a conductive layer coating fluid which contains $TiO_2$ particles coated with oxygen deficient $SnO_2$ having an average particle diameter of from 0.20 μm or more to 0.60 μm or less; and the conductive layer has a volume resistivity of from more than $8.0\times10^8$ Ωcm to $1.0\times10^{11}$ Ωcm or less.

The present invention is also a process cartridge and an electrophotographic apparatus which have the above electrophotographic photosensitive member.

The present invention is still also a process for producing an electrophotographic photosensitive member; the process having a conductive layer forming step of forming on a support a conductive layer having a volume resistivity of from more than $8.0\times10^8$ Ωcm to $1.0\times10^{11}$ Ωcm or less, an intermediate layer forming step of forming an intermediate layer on the conductive layer, and a photosensitive layer forming step of forming a photosensitive layer on the intermediate layer;

In the conductive layer forming step, the layer being formed by using a conductive layer coating fluid which contains TiO2 particles coated with oxygen deficient SnO2 coated with oxygen deficient $SnO_2$ having an average particle diameter of from 0.20 μm or more to 0.60 μm or less.

According to the present invention, an electrophotographic photosensitive member can be provided in which the charging lines are difficult to cause even when employing the type-(iii) constitution between the support and the photosensitive layer.

According to the present invention, a process cartridge and an electrophotographic apparatus also can be provided having the electrophotographic photosensitive member in which it is difficult to cause the charging lines.

Figure 1A:
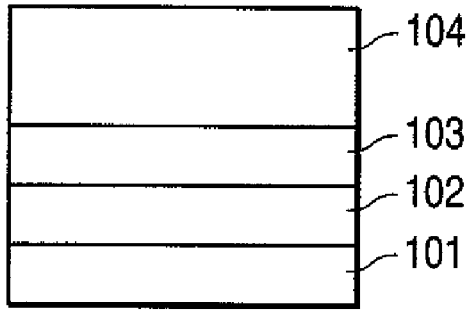
FIG. 1A illustrates an example of the layer constitution of the electrophotographic photosensitive member of the present invention.
Figure 1B:
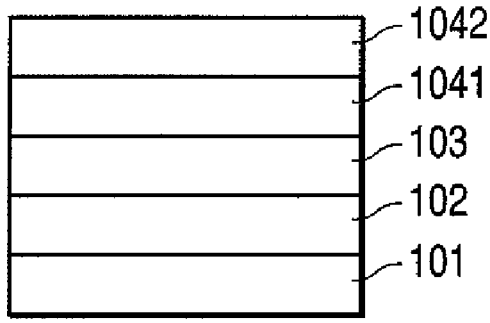
FIG. 1B illustrates an example of the layer constitution of the electrophotographic photosensitive member of the present invention.
Figure 1C:
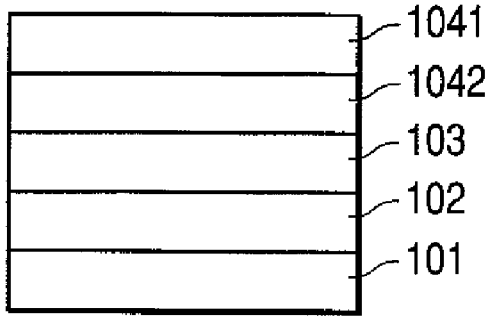
FIG. 1C illustrates an example of the layer constitution of the electrophotographic photosensitive member of the present invention.

What is denoted by reference numerals in the drawings is:

101: support;
102: conductive layer;
103: intermediate layer;
104: photosensitive layer;
1041: charge generation layer;
1042: charge transport layer;
105: protective layer;
1: electrophotographic photosensitive member;
2: axis;
3: charging means (primary charging means);
4: exposure light (imagewise exposure light);
5: developing means;
6: transfer means (transfer roller);
7: cleaning means (cleaning blade);
8: fixing means;
9: process cartridge;
10: guide means; and
11: pre-exposure light.
P denotes a transfer material (such as paper).

BEST MODE FOR CARRYING OUT THE INVENTION

The present invention is described below in greater detail.

The electrophotographic photosensitive member of the present invention has a support, a conductive layer formed on the support, an intermediate layer formed on the conductive layer, and a photosensitive layer formed on the intermediate layer.

In the present invention, particles including $TiO_2$ particles coated with $SnO_2$ whose resistivity has been reduced by effecting oxygen deficiency are used as a conductive material to be incorporated in the conductive layer. In the present invention, such particles are referred to as "$TiO_2$ particles coated with oxygen deficient $SnO_2$". As a result of decreasing the resistivity in this way, the particles have been made to have a resistivity reduced to about 1/10,000 in terms of powder resistivity.

The oxygen deficient $SnO_2$ has reuse properties superior to $SnO_2$ doped with a different element such as antimony. In addition, with the oxygen deficient $SnO_2$, increase in resistivity in a low-humidity environment and decrease in resistivity in a high-humidity environment are less, and hence it is superior in environmental stability.

The conductive material for the conductive layer used in the present invention is also not particles consisting of only the oxygen deficient $SnO_2$ (oxygen deficient $SnO_2$ particles), but the $TiO_2$ particles coated with oxygen deficient $SnO_2$. The reason therefor is as follows:

First, the use of core particles ($TiO_2$ particles) is to improve the dispersibility of particles in a conductive layer coating fluid. If a conductive layer coating fluid is prepared using the oxygen deficient $SnO_2$, the oxygen deficient $SnO_2$ tend to become agglomerated especially when the oxygen deficient $SnO_2$ is contained in a high percentage.

Then, $TiO_2$ particles are used as the core particles for the reason that the affinity between the oxygen deficient moiety of the oxygen deficient $SnO_2$ and the oxide moiety at the $TiO_2$ particle surfaces strengthens the bonding between oxygen deficient $SnO_2$ coat layers and the core material. The oxygen deficient $SnO_2$, unlike doped $SnO_2$, may be oxidized in the presence of oxygen to lose oxygen deficient moieties, resulting in low conductivity (high powder resistivity). However, using the $TiO_2$ particles as the core particles protects, the oxygen deficient moieties of the oxygen deficient $SnO_2$ is protected.

Where exposure light (image exposure light) is laser light, the core particles $TiO_2$ particles can also keep interference fringes from appearing on reproduced images because of interference of light reflecting from the support surface at the time of laser exposure.

In addition, a method for producing the $TiO_2$ particles coated with oxygen deficient $SnO_2$ (a method for preparing the oxygen deficient $SnO_2$ and a method for coating the $TiO_2$ particles with the oxygen deficient $SnO_2$) are disclosed in Japanese Patent Applications Laid-open Nos. H07-295245 and H04-154621.

In order to keep the charging lines from occurring, the conductive layer is required to have a volume resistivity of from more than $8.0\times10^8$ Ωcm to $1.0\times10^{11}$ Ωcm or less. The conductive layer may preferably have a low resistivity. However, in order to keep the charging lines from occurring in a low-temperature and low-humidity environment, the conductive layer is required to have a volume resistivity of $1.0\times10^{11}$ Ωcm or less. On the other hand, if the conductive layer has too low resistivity, spots and fog may occur because of the injection of electric charges into the photosensitive layer in a high-temperature and high-humidity environment, and hence the conductive layer may preferably have a volume resistivity of more than $8.0\times10^8$ Ωcm.

In the present invention, the volume resistivity of the conductive layer is measured in the following way.

First, using the conductive layer coating fluid, a conductive layer sample (layer thickness: about 10 to 15 μm; the layer thickness may preferably be the same as that of the conductive layer of the electrophotographic photosensitive member) is formed on an aluminum sheet. On this conductive layer sample, a thin film of gold is formed by vacuum deposition. The value of electric current flowing across the two electrodes of the aluminum sheet and the thin film of gold is measured with a picoammeter (pA meter). The measurement is performed in an environment of 23° C./60% RH. A voltage of 0.1 V is applied. One minute after the start of the measurement of the value of electric current, a value having become stable is read, and the volume resistivity of the conductive layer is derived therefrom.

In order to hold the volume resistivity of the conductive layer within the above range, it is preferable to use $TiO_2$ particles coated with oxygen deficient $SnO_2$ having powder resistivity in the range of from 1 to 500 Ωcm, and more preferably in the range of from 1 to 250 Ωcm. A conductive layer coating fluid prepared using $TiO_2$ particles coated with oxygen deficient $SnO_2$ having too high powder resistivity makes it difficult to hold the volume resistivity of the conductive layer within the above range. On the other hand, a conductive layer coating fluid prepared using $TiO_2$ particles coated with oxygen deficient $SnO_2$ having too low powder resistivity may produce an electrophotographic photosensitive member having low chargeability.

In order to stably obtain the $TiO_2$ particles coated with oxygen deficient $SnO_2$ having volume resistivity within the above range, the mixing proportion of raw materials may be controlled when the particles are produced. For example, a tin raw-material necessary for producing $SnO_2$ in an amount of from 30 to 60 mass % based on the $TiO_2$ particles coated with oxygen deficient $SnO_2$ may be mixed when the particles are produced (as calculated assuming that the purity of $SnO_2$ obtained from the tin raw-material is 100%). In other words, it is preferable that the coverage of the oxygen deficient $SnO_2$ on the $TiO_2$ particles is from 30 to 60 mass %.

The powder resistivity in the present invention is measured in the following way.

A resistance measuring instrument LORESTA AP, manufactured by Mitsubishi Chemical Corporation, is used as a measuring instrument. A measurement object powder (i.e., particles) is compacted at a pressure of 500 kg/cm$^2$ to prepare a pellet-shaped measuring sample. The measurement is performed in an environment of 23° C./60% RH. A voltage of 100 V is applied.

In order to keep the charging lines from occurring, the $TiO_2$ particles coated with oxygen deficient $SnO_2$ are also required to have an average particle diameter of from 0.20 μm or more to 0.60 μm or less in the conductive layer coating fluid. In the $TiO_2$ particles coated with oxygen deficient $SnO_2$ contained in the conductive layer coating fluid, $TiO_2$ particles coated with oxygen deficient $SnO_2$ of from 0.10 μm or more to 0.40 μm or less in particle diameter may preferably be in a proportion of 45% by number or more, and more preferably 60% by number or more, based on the number of all the $TiO_2$ particles coated with oxygen deficient $SnO_2$ contained in the conductive layer coating fluid.

In the present invention, the particle diameter (inclusive of average particle diameter and particle size distribution) of the $TiO_2$ particles coated with oxygen deficient $SnO_2$ in the conductive layer coating fluid is measured by a liquid-phase sedimentation method in the following way.

First, the conductive layer coating fluid is diluted with the same solvent included therein, to have a transmittance of 0.8 or more and 1.0 or less. Next, a histogram of average particle diameter (volume-base D50) and particle size distribution is made out by measurement using an ultra-centrifugal automatic particle size distribution measuring instrument (CAPA 700) manufactured by Horiba Ltd. at the number of revolutions of 3,000 rpm.

Even where the conductive layer has the same composition, the powder resistivity decreases as the average particle diameter of the $TiO_2$ particles coated with oxygen deficient $SnO_2$ increases, and at the same time, the volume resistivity also decreases.

If the $TiO_2$ particles coated with oxygen deficient $SnO_2$ have an average particle diameter of less than 0.20 μm, the $TiO_2$ particles coated with oxygen deficient $SnO_2$ must be used in a large quantity in order to hold the volume resistivity of the conductive layer within the above range. However, if the $TiO_2$ particles coated with oxygen deficient $SnO_2$ are used in a large quantity, it is difficult to achieve the conductive-layer surface roughness (Rz jis: 1 to 3 μm) that is preferable in order to keep interference fringes from appearing on reproduced images because of interference of light reflecting from the surface of the conductive layer. In addition, Rz jis corresponds to what has ever been defined as Rz in JIS B 0601 (1994). The JIS B 0601 standard has been revised in 2001, and the Rz has been revised and replaced by Ry (maximum height) used in 1994. The Rz in 1994 has been changed in 2001 for the purpose of distinction, and named Rz jis.

If the $TiO_2$ particles coated with oxygen deficient $SnO_2$ are used in a large quantity, the conductive layer tends to come cracked when it has a large layer thickness, to have low film properties.

On the other hand, where the $TiO_2$ particles coated with oxygen deficient $SnO_2$ have an average particle diameter of more than 0.60 μm, or, even though not more than that, where the $TiO_2$ particles coated with oxygen deficient $SnO_2$ of from 0.10 μm or more to 0.40 μm or less in particle diameter are in a proportion of less than 45% by number, it is possible to hold the volume resistivity of the conductive layer within the above range. However, the surface of the conductive layer may become extremely rough to tend to cause local injection of electric charges into the photosensitive layer, and in some case, spots appear conspicuously on the white background in reproduced images.

In the present invention, the conductive layer may be formed by coating the support with a conductive layer coating fluid obtained by dispersing in a binding material together with a solvent the $TiO_2$ particles coated with oxygen deficient $SnO_2$ having an average particle diameter of from 0.20 μm or more to 0.60 μm or less, and then drying the wet coating formed. For dispersing the particles, a method is available which makes use of a paint shaker, a sand mill, a ball mill, a liquid impact type high-speed dispersion machine or the like.

The solvent used for the conductive layer coating fluid may be exemplified by the following: Alcohols such as methanol, ethanol and isopropanol; ketones such as acetone, methyl ethyl ketone and cyclohexanone; ethers such as tetrahydrofuran, dioxane, ethylene glycol monomethyl ether and propylene glycol monomethyl ether; esters such as methyl acetate and ethyl acetate; and aromatic hydrocarbons such as toluene and xylene.

From the viewpoint of the covering of surface defects of the support, the conductive layer may preferably have a layer thickness of from 10 μm or more to 25 μm or less, and more preferably from 15 μm or more to 20 μm or less.

In addition, in the present invention, the layer thickness of each layer inclusive of the conductive layer, of the electrophotographic photosensitive member is measured with FISCHERSCOPE Multi Measurement System (mms), available from Fisher Instruments Co.

The binding material of the conductive layer may include resins (binder resins) such as phenol resin, polyurethane, polyamide, polyimide, polyamide-imide, polyvinyl acetal, epoxy resin, acrylic resin, melamine resin and polyester. One or two or more of these may be used. Also, among various resins, the binder resin of the conductive layer may preferably be a hardening resin, and more preferably a thermosetting resin, from the viewpoint of the prevention of migration to other layer(s), the adhesiveness to the support, the dispersibility and dispersion stability of the conductive material, the solvent resistance after film formation, and so forth. Specifically, thermosetting phenol resin and polyurethane are preferred. In the case where the hardening resin is used as the binder resin of the conductive layer, the binding material to be contained in the conductive layer coating fluid includes a monomer and/or an oligomer of the hardening resin.

It is also preferable that in the conductive layer coating fluid, the $TiO_2$ particles coated with oxygen deficient $SnO_2$ (P) and the binding material (B) are in a mass ratio (P:B) ranging from 2.3:1.0 to 3.3:1.0. If the $TiO_2$ particles coated with oxygen deficient $SnO_2$ are in too small proportion, it is difficult to hold the volume resistivity of the conductive layer within the above range. If the $TiO_2$ particles coated with oxygen deficient $SnO_2$ are in too large proportion, it is difficult for the $TiO_2$ particles coated with oxygen deficient $SnO_2$ to bind in the conductive layer, tending to cause cracking.

In order to keep interference fringes from appearing on reproduced images because of interference of light reflecting from the surface of the conductive layer, a surface roughness providing material for roughening the surface of the conductive layer may be added to the conductive layer coating fluid. Such a surface roughness providing material may preferably be resin particles having an average particle diameter of from 1 μm or more to 3 μm or less. For example, such particles may include particles of hardening rubbers and of hardening resins such as polyurethane, epoxy resin, alkyd resin, phenol resin, polyester, silicone resin and acryl-melamine resin. In particular, particles of silicone resin are preferred as being less agglomerative. The specific gravity of resin particles (which is 0.5 to 2) is smaller than the specific gravity of $TiO_2$ particles coated with oxygen deficient $SnO_2$ (which is 4 to 7), and hence the surface of the conductive layer can efficiently be roughened at the time of formation of the conductive layer. However, the conductive layer has a tendency to increase volume resistivity as the content of the surface roughness providing material in the conductive layer increases. Hence, in order to hold the volume resistivity of the conductive layer within the above range, the content of the surface roughness providing material in the conductive layer may preferably be so controlled as to be from 15 to 25 mass % based on the binder resin in the conductive layer.

A leveling agent may be added in order to enhance the surface properties of the conductive layer, and pigment particles may be incorporated in the conductive layer in order to improve the covering properties of the conductive layer.

In order to block the injection of electric charges from the conductive layer into the photosensitive layer, it is necessary that an intermediate layer having electrical barrier properties is provided between the conductive layer and the photosensitive layer. Such an intermediate layer may preferably have a volume resistivity of from $1.0\times10^9$ Ωcm or more to $1.0\times10^{13}$ Ωcm or less. If the intermediate layer has too low volume resistivity, it may have poor electrical barrier properties to tend to seriously cause spots and fog due to the injection of electric charges from the conductive layer. If on the other hand the intermediate layer has too high volume resistivity, the flow of electric charges (carriers) may stagnate at the time of image formation to tend to result in a serious rise in residual potential.

The volume resistivity of the intermediate layer in the present invention is measured in the following way.

First, using an intermediate layer coating fluid, an intermediate layer sample (layer thickness: about 2 to 5 μm) is formed on an aluminum sheet. On this intermediate layer sample, a thin film of gold is formed by vacuum deposition. The value of electric current flowing across the two electrodes of the aluminum sheet and the thin film of gold is measured with a picoammeter (pA meter). The measurement is measured in an environment of 23° C./60% RH. A voltage of 100 V is applied. One minute after the start of the measurement of the value of electric current, a value having become stable is read, and the volume resistivity of the intermediate layer is derived therefrom.

The intermediate layer may be formed by coating the conductive layer with an intermediate layer coating fluid containing a binder resin, and drying the wet coating formed.

The binder resin for the intermediate layer may be exemplified by the following: Water-soluble resins such as polyvinyl alcohol, polyvinyl methyl ether, polyacrylic acids, methyl cellulose, ethyl cellulose, polyglutamic acid, casein and starch; and polyamide, polyimide, polyamide-imide, polyamic acid, melamine resin, epoxy resin, polyurethane, and polyglutamates.

In order to effectively bring out the electrical barrier properties, and from the viewpoint of coatability, adhesiveness, solvent resistance and electrical resistance, the binder resin for the intermediate layer may preferably be a thermoplastic resin. Specifically, a thermoplastic polyamide is preferred. As the polyamide, a low-crystallizable or non-crystallizable copolymer nylon or the like is preferred as being able to be coated in the state of solution. Also, the intermediate layer may preferably have a layer thickness of from 0.1 μm or more to 2 μm or less.

In a multi-layer sample prepared by using the conductive layer coating fluid and the intermediate layer coating fluid and by superposing the conductive layer sample and the intermediate layer sample in this order, it is preferred to satisfy the relationship of $0.2 \leqq Imin/I(0) \leqq 1.0$ where under the application of a voltage of 0.10 V/μm to the multi-layer sample total thickness (the layer thickness of the conductive layer sample+ the layer thickness of the intermediate layer sample), the value of electric current at voltage application time t second is represented by I(t), and the minimum value of electric current I(t) in the range of $0 \leqq t \leqq 300$ is represented by Imin.

A method for measuring the value of electric current with respect to the voltage application time and a method for determining the value of Imin/I(0) are described below.

In the multi-layer sample, the layer thickness of the conductive layer sample and the layer thickness of the intermediate layer sample may preferably be equal respectively to the layer thickness of the conductive layer and the layer thickness of the intermediate layer of the electrophotographic photosensitive member. Specifically, the conductive layer sample is formed on an aluminum sheet in a layer thickness of from 10 to 15 μm, and the intermediate layer is formed thereon in a layer thickness of from 0.5 to 1.5 μm.

First, a thin film of gold is formed on the intermediate layer sample by vacuum deposition, and a voltage of 0.10 V/μm is applied to the multi-layer sample total thickness through the two electrodes of the aluminum sheet and the thin film of gold from a constant-voltage power source. Next, the value of electric current flowing across the two electrodes of the aluminum sheet and thin film of gold is measured with a picoammeter (pA meter). The measurement is performed in an environment of 23° C./60% RH. A voltage of 100 V is applied. The value of electric current is measured until 300 seconds has passed, regarding the voltage application starting time as 0 second. Further, the minimum value of electric current measured during 0 second to 300 seconds is represented by Imin, where the value of I(0) is found by extrapolation from values present in the range of 5 seconds or less, obtaining the value of Imin/I(0).

The value of Imin/I(0) is considered to be influenced by the movement of electric charges at the interface between the conductive layer and the intermediate layer. It is considered that as the value of Imin/I(0) is smaller, the movement of electric charges at the interface between the conductive layer and the intermediate layer is not smoother, showing that the electric charges stand easily come stagnant at the interface between the conductive layer and the intermediate layer. In order to keep the charging lines from occurring, the value of Imin/I(0) may preferably be 0.2 or more. The closer to 1.0, the more effective in order to keep the charging lines from occurring.

An electron transport material (an electron accepting material such as an acceptor) may be incorporated in the intermediate layer in order for the flow of electric charges (carriers) not to stagnate in the intermediate layer.

The constitution of the electrophotographic photosensitive member of the present invention is described below.

As shown in FIGS. 1A, 1B, 1C and 1D, the electrophotographic photosensitive member of the present invention is an electrophotographic photosensitive member having on a support 101 a conductive layer 102, an intermediate layer 103, a photosensitive layer 104 (a charge generation layer 1041, a charge transport layer 1042) in this order.

The photosensitive layer may be either of a single-layer type photosensitive layer which contains a charge transporting material and a charge generating material in the same layer (see FIG. 1A) and a multi-layer type (function-separated type) photosensitive layer which is separated into a charge generation layer 1041 containing a charge generating material and a charge transport layer 1042 containing a charge transporting material. From the viewpoint of electrophotographic performance, the multi-layer type photosensitive layer is preferred. The multi-layer type photosensitive layer may also include a regular-layer type photosensitive layer in which the charge generation layer 1041 and the charge transport layer 1042 are superposed in this order from the support 101 side (see FIG. 1B) and a reverse-layer type photosensitive layer in which the charge transport layer 1042 and the charge generation layer 1041 are superposed in this order from the support 101 side (see FIG. 1C). From the viewpoint of electrophotographic performance, the regular-layer type photosensitive layer is preferred.

Figure 1D:
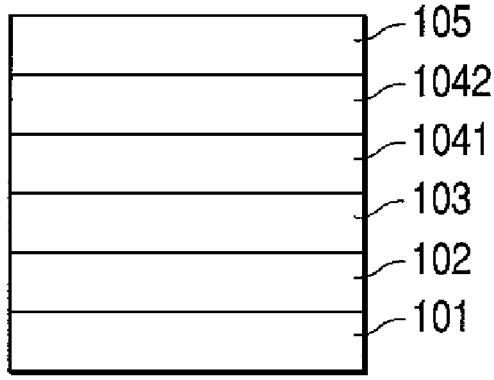
FIG. 1D illustrates an example of the layer constitution of the electrophotographic photosensitive member of the present invention.

A protective layer 105 may also be provided on the photosensitive layer 104 (the charge generation layer 1041 or the charge transport layer 1042) (see FIG. 1D).

As the support, it may be one having conductivity (conductive support). For example, supports made of a metal such as aluminum, aluminum alloy or stainless steel are usable. In the case of aluminum or aluminum alloy, the following are usable: an aluminum pipe produced by a production process having the step of extrusion and the step of drawing, an aluminum pipe produced by a production process having the step of extrusion and the step of ironing, and also those obtained by subjecting these pipes to cutting, electrolytic composite polishing (electrolysis carried out using i) an electrode having electrolytic action and ii) an electrolytic solution, and polishing carried out using a grinding stone having polishing action) or to wet-process or dry-process honing. It is possible to use also the above supports made of a metal, or supports made of a resin (such as polyethylene terephthalate, polybutylene terephthalate, phenol resin, polypropylene or polystyrene), and having layers formed by vacuum deposition of aluminum, aluminum alloy, indium oxide-tin oxide alloy or the like. It is possible to use also supports including resin or paper impregnated with a conductive material such as carbon black, tin oxide particles, titanium oxide particles or silver particles, and supports made of a plastic containing a conductive binder resin.

In order to flow electric charges (carriers) of the conductive layer to the ground, the conductive support or, where the surface of the support is a layer formed in order to provide conductivity, such a layer may have a volume resistivity of preferably $1.0 \times 10^{10}$ Ωcm or less and, in particular, more preferably $1.0 \times 10^{6}$ Ωcm or less.

Where the support is a non-conductive support, it is necessary to employ a constitution in which the ground is set up from the conductive layer of the electrophotographic photosensitive member of the present invention.

The conductive layer is formed on the support, and the intermediate layer is formed on the conductive layer. In regard to the conductive layer and the intermediate layer, they are as described previously.

The photosensitive layer is formed on the intermediate layer.

The charge generating material used in the electrophotographic photosensitive member of the present invention may be exemplified by the following: Azo pigments such as monoazo, disazo and trisazo, phthalocyanine pigments such as metal phthalocyanines and metal-free phthalocyanine, indigo pigments such as indigo and thioindigo, perylene pigments such as perylene acid anhydrides and perylene acid imides, polycyclic quinone pigments such as anthraquinone and pyrenequinone, squarilium dyes, pyrylium salts and thiapyrylium salts, triphenylmethane dyes, inorganic materials such as selenium, selenium-tellurium and amorphous silicon, quinacridone pigments, azulenium salt pigments, cyanine dyes, xanthene dyes, quinoneimine dyes, styryl dyes, cadmium sulfide, and zinc oxide.

Of these, particularly preferred are metal phthalocyanines such as oxytitanium phthalocyanine, hydroxygallium phthalocyanine and chlorogallium phthalocyanine.

In the case where the photosensitive layer is the multi-layer type photosensitive layer, the binder resin used to form the charge generation layer may be exemplified by the following: Polycarbonate, polyester, polyarylate, butyral resin, polystyrene, polyvinyl acetal, diallyl phthalate resin, acrylic resin, methacrylic resin, vinyl acetate resin, phenol resin, silicone resin, polysulfone, styrene-butadiene copolymer, alkyd resin, epoxy resin, urea resin, and vinyl chloride-vinyl acetate copolymer. Any of these may be used alone or in the form of a mixture or copolymer of two or more types.

The charge generation layer may be formed by coating a charge generation layer coating fluid obtained by dispersing the charge generating material in the binder resin together with a solvent, and drying the wet coating formed. As a method for dispersion, a method is available which makes use of a homogenizer, ultrasonic waves, a ball mill, a sand mill, an attritor or a roll mill. The charge generating material and the binder resin may preferably be in a proportion ranging from 10:1 to 1:10 (mass ratio) and, in particular, more preferably from 3:1 to 1:1 (mass ratio).

The solvent used for the charge generation layer coating fluid may be selected taking into account the binder resin to be used and the solubility or dispersion stability of the charge generating material. As an organic solvent, it may include alcohols, sulfoxides, ketones, ethers, esters, aliphatic halogenated hydrocarbons and aromatic compounds.

When the charge generation layer coating fluid is applied, coating methods are usable as exemplified by dip coating, spray coating, spinner coating, roller coating, Mayer bar coating and blade coating.

The charge generation layer may preferably be in a layer thickness of 5 μm or less, and more preferably from 0.1 μm or more to 2 μm or less.

To the charge generation layer, a sensitizer, an antioxidant, an ultraviolet absorber, a plasticizer and so forth which may be of various types may optionally be added. An electron transport material (an electron accepting material such as an acceptor) may also be incorporated in the charge generation layer in order for the flow of electric charges (carriers) not to stagnate in the charge generation layer.

The charge transporting material used in the electrophotographic photosensitive member of the present invention may include, e.g., triarylamine compounds, hydrazone compounds, styryl compounds, stilbene compounds, pyrazoline compounds, oxazole compounds, thiazole compounds, and triarylmethane compounds.

In the case where the photosensitive layer is the multi-layer type photosensitive layer, the binder resin used to form the charge transport layer may be exemplified by the following: Acrylic resin, styrene resin, polyester, polycarbonate, polyarylate, polysulfone, polyphenylene oxide, epoxy resin, polyurethane, alkyd resin and unsaturated resins. In particular, polymethyl methacrylate (PMMA), polystyrene, styrene-acrylonitrile copolymer, polycarbonate, polyarylate, and diallyl phthalate resin are preferred. Also, any of these may be used alone or in the form of a mixture or copolymer of two or more types.

The charge transport layer may be formed by applying a charge transport layer coating fluid obtained by dissolving the charge transporting material and binder resin in a solvent, and drying the wet coating formed. The charge transporting material and the binder resin may preferably be in a proportion ranging from 2:1 to 1:2 (mass ratio).

The solvent used for the charge transport layer coating fluid may be exemplified by the following: Ketones such as acetone and methyl ethyl ketone, esters such as methyl acetate and ethyl acetate, aromatic hydrocarbons such as toluene and xylene, ethers such as dimethoxymethane and dimethoxyethane, aromatic hydrocarbons such as toluene and xylene, and hydrocarbons substituted with a halogen atom, such as chlorobenzene, chloroform and carbon tetrachloride.

When the charge transport layer coating fluid is applied, coating methods are usable as exemplified by dip coating, spray coating, spinner coating, roller coating, Mayer bar coating and blade coating.

The charge transport layer may preferably be in a layer thickness of from 5 μm or more to 40 μm or less, and more preferably from 10 μm or more to 20 μm or less from the viewpoint of charging uniformity.

To the charge transport layer, an antioxidant, an ultraviolet absorber, a plasticizer and so forth may optionally be added.

In the case where the photosensitive layer is the single-layer type photosensitive layer, the single-layer type photosensitive layer may be formed by applying a single-layer type photosensitive layer coating fluid obtained by dispersing the above charge generating material and charge transporting material in the above binder resin together with the above solvent, and drying the wet coating formed.

A protective layer aimed at protecting the photosensitive layer may also be provided on the photosensitive layer. The protective layer may be formed by applying a protective layer coating fluid obtained by dissolving a binder resin of various types in a solvent, and drying the wet coating formed.

The protective layer may preferably be in a layer thickness of from 0.5 μm or more to 10 μm or less, and more preferably from 1 μm or more to 5 μm or less.

A charging member used preferably in the present invention is described below.

The charging member used preferably in the present invention is a member having the shape of a roller (hereinafter also "charging roller"). It may be constituted of, e.g., a conductive substrate and one or two or more cover layers formed on the conductive substrate. At least one of the cover layers is provided with conductivity. Stated more specifically, it may be constituted of a conductive substrate, a conductive elastic layer formed on the conductive substrate, and a surface layer formed on the conductive elastic layer.

The surface of the charging member may preferably have a ten-point average roughness (Rz jis) of 5.0 μm or less.

The ten-point average roughness (Rz jis) of the surface of the charging member is measured with a surface profile analyzer SE-3400, manufactured by Kosaka Laboratory Ltd. More specifically, Rz jis is measured with this measuring instrument at any six points on the surface of the charging member, and an average value of measurement values at the six points is regarded as the ten-point average roughness.

If the charging member has too large surface roughness, a developer (toner and its external additives) tends to adhere to the surface of the charging member as a result of continuous image reproduction, resulting in contamination of the charging member surface appearing on the images reproduced.

By controlling the surface of the charging member to have the roughness within the specific range, it is possible to keep small the difference in quantity of electric charges in discharge due to difference in level of unevenness of the surface.

Thus, faulty images such as spots can be kept from occurring because of faulty charging ascribable to the surface profile of the charging member.

Figure 2:
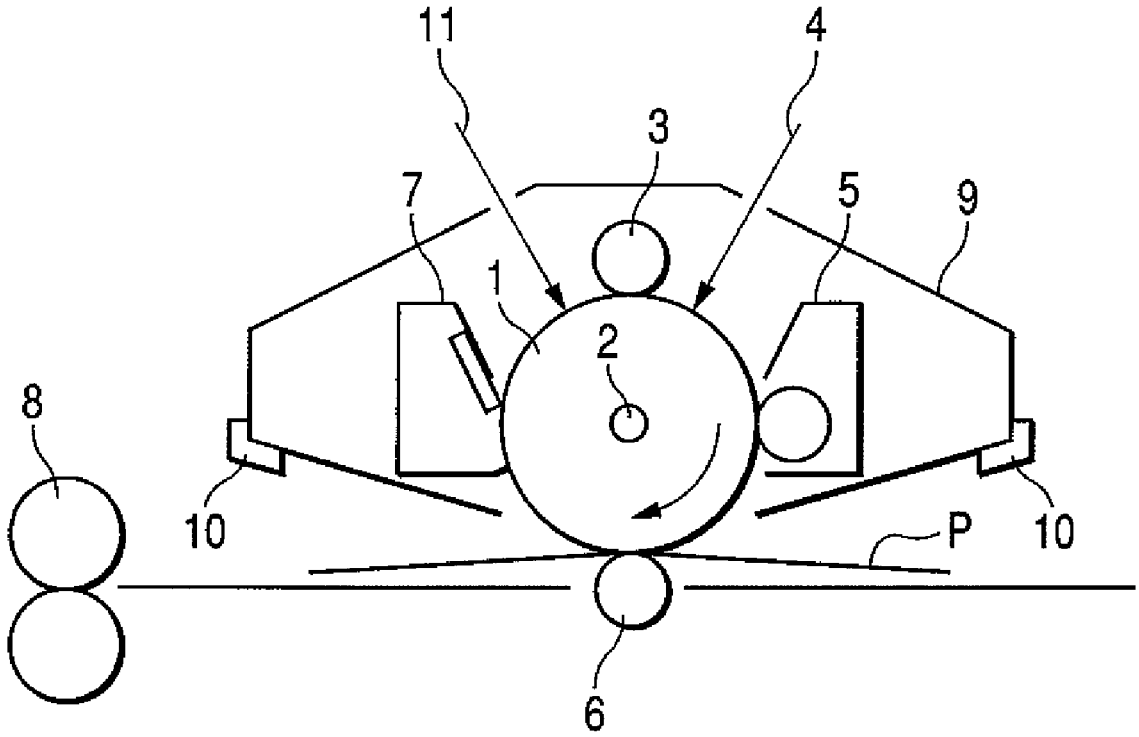
FIG. 2 schematically illustrates an example of the construction of an electrophotographic apparatus provided with a process cartridge having the electrophotographic photosensitive member of the present invention.

FIG. 2 schematically illustrates an example of the construction of an electrophotographic apparatus provided with a process cartridge having the electrophotographic photosensitive member of the present invention.

In FIG. 2, reference numeral 1 denotes a drum-shaped electrophotographic photosensitive member, which is rotatively driven around an axis 2 in the direction of an arrow at a given peripheral speed.

The peripheral surface of the electrophotographic photosensitive member 1 rotatively driven is uniformly charged to a positive or negative, given potential through a charging means 3. The electrophotographic photosensitive member thus charged is then exposed to exposure light (image exposure light) 4 emitted from an exposure means (not shown) for slit exposure, laser beam scanning exposure or the like. In this way, electrostatic latent images corresponding to the intended image are successively formed on the peripheral surface of the electrophotographic photosensitive member 1. Voltage to be applied to the charging means 3 may be only direct-current voltage or may be direct-current voltage on which alternating-current voltage is superimposed.

The electrostatic latent images thus formed on the peripheral surface of the electrophotographic photosensitive member 1 are developed with a toner of a developing means 5 to form toner images. Then, the toner images thus formed and held on the peripheral surface of the electrophotographic photosensitive member 1 are successively transferred onto a transfer material (such as paper) P by applying a transfer bias from a transfer means (a transfer roller) 6. In addition, the transfer material is fed through a transfer material feed means (not shown) to the part (contact zone) between the electrophotographic photosensitive member 1 and the transfer means 6 in such a manner as synchronized with the rotation of the electrophotographic photosensitive member 1.

The transfer material P to which the toner images have been transferred is separated from the peripheral surface of the electrophotographic photosensitive member 1 and is led into a fixing means 8, where the toner images are fixed, and is then put out of the apparatus as an image-formed material (a print or copy).

The surface of the electrophotographic photosensitive member 1 from which toner images have been transferred is subjected to removal of the developer (toner) remaining after the transfer through a cleaning means (such as a cleaning blade) 7, and thus is cleaned. It is further subjected to charge elimination by pre-exposure light 11 emitted from a pre-exposure means (not shown), and thereafter repeatedly used for image formation.

The apparatus may be constituted of a combination of plural components integrally held in a container as a process cartridge from among the constituents such as the above electrophotographic photosensitive member 1, charging means 3, developing means 5, transfer means 6 and cleaning means 7 so that the process cartridge is set detachably mountable to the main body of an electrophotographic apparatus. In FIG. 2, the electrophotographic photosensitive member 1 and the charging means 3, developing means 5 and cleaning means 7 are integrally held to form a process cartridge 9 detachably mountable to the main body of the electrophotographic apparatus through a guide means 10 such as rails installed in the main body of the electrophotographic apparatus.

EXAMPLES

The present invention is described below in greater detail by giving specific working examples. The present invention, however, is by no means limited to these. In the following Examples, "part(s)" refers to "part(s) by mass".

Conductive Layer Coating Fluid Preparation Examples

Preparation of Conductive Layer Coating Fluid A 55 parts of $TiO_2$ particles coated with oxygen deficient $SnO_2$ (powder resistivity: 100 Ωcm; coverage of $SnO_2$ in mass percentage: 40%), 36.5 parts of phenol resin (trade name: PLYOPHEN J-325; available from Dainippon Ink & Chemicals, Incorporated; resin solid content: 60%) as a binder resin and 35 parts of methoxypropanol as a solvent were subjected to dispersion for 3 hours by means of a sand mill making use of glass beads of 1 mm in diameter to prepare a fluid dispersion.

To this fluid dispersion, 3.9 parts of silicone resin particles (trade name: TOSPEARL 120; available from GE Toshiba Silicones; average particle diameter: 2 μm) as a surface roughness providing material and 0.001 part of silicone oil (trade name: SH28PA; available from Dow Corning Toray Silicone Co., Ltd.) as a leveling agent were added, followed by stirring to prepare Conductive Layer Coating Fluid A.

The $TiO_2$ particles coated with oxygen deficient $SnO_2$ in this conductive layer coating fluid had an average particle diameter of 0.36 μm. In the particles, particles having particle diameters in the range of from 0.10 μm to 0.40 μm were in a proportion of 61.2 mass %.

Preparation of Conductive Layer Coating Fluid B

Conductive Layer Coating Fluid B was prepared in the same manner as in Conductive Layer Coating Fluid A except that the dispersion time was changed to 4 hours.

The $TiO_2$ particles coated with oxygen deficient $SnO_2$ in this conductive layer coating fluid had an average particle diameter of 0.33 μm. In the particles, particles having particle diameters in the range of from 0.10 μm to 0.40 μm were in a proportion of 64.8 mass %.

Preparation of Conductive Layer Coating Fluid C

Conductive Layer Coating Fluid C was prepared in the same manner as in Conductive Layer Coating Fluid A except that the dispersion time was changed to 1 hour.

The $TiO_2$ particles coated with oxygen deficient $SnO_2$ in this conductive layer coating fluid had an average particle diameter of 0.47 μm. In the particles, particles having particle diameters in the range of from 0.10 μm to 0.40 μm were in a proportion of 47.1 mass %.

Preparation of Conductive Layer Coating Fluid D

Conductive Layer Coating Fluid D was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of $TiO_2$ particles coated with oxygen deficient $SnO_2$ (powder resistivity: 500 Ωcm; coverage of $SnO_2$ in mass percentage: 30%).

The $TiO_2$ particles coated with oxygen deficient $SnO_2$ in this conductive layer coating fluid had an average particle diameter of 0.23 μm. In the particles, particles having particle diameters in the range of from 0.10 μm to 0.40 μm were in a proportion of 92.5 mass %.

Preparation of Conductive Layer Coating Fluid E

Conductive Layer Coating Fluid E was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of $TiO_2$ particles coated with oxygen deficient $SnO_2$ (powder resistivity: 220 Ωcm; coverage of $SnO_2$ in mass percentage: 35%).

The $TiO_2$ particles coated with oxygen deficient $SnO_2$ in this conductive layer coating fluid had an average particle diameter of 0.30 μm. In the particles, particles having particle diameters in the range of from 0.10 μm to 0.40 μm were in a proportion of 67.0 mass %.

Preparation of Conductive Layer Coating Fluid F

Conductive Layer Coating Fluid F was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of $TiO_2$ particles coated with oxygen deficient $SnO_2$ (powder resistivity: 800 Ωcm; coverage of $SnO_2$ in mass percentage: 25%).

The $TiO_2$ particles coated with oxygen deficient $SnO_2$ in this conductive layer coating fluid had an average particle diameter of 0.20 μm. In the particles, particles having particle diameters in the range of from 0.10 μm to 0.40 μm were in a proportion of 90.0% by mass.

Preparation of Conductive Layer Coating Fluid G

Conductive Layer Coating Fluid G was prepared in the same manner as Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of $TiO_2$ particles coated with oxygen deficient $SnO_2$ (powder resistivity: 800 Ωcm; coverage of $SnO_2$ in mass percentage: 50%).

The $TiO_2$ particles coated with oxygen deficient $SnO_2$ in this conductive layer coating fluid had an average particle diameter of 0.45 μm. In the particles, particles having particle diameters in the range of from 0.10 μm to 0.40 μm were in a proportion of 45.3 mass %.

Preparation of Conductive Layer Coating Fluid H

Conductive Layer Coating Fluid H was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of $TiO_2$ particles coated with oxygen deficient $SnO_2$ (powder resistivity: 800 Ωcm; coverage of $SnO_2$ in mass percentage: 60%).

The $TiO_2$ particles coated with oxygen deficient $SnO_2$ in this conductive layer coating fluid had an average particle diameter of 0.51 μm. In the particles, particles having particle diameters in the range of from 0.10 μm to 0.40 μm were in a proportion of 40.4 mass %.

Preparation of Conductive Layer Coating Fluid I

Conductive Layer Coating Fluid I was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of $TiO_2$ particles coated with oxygen deficient $SnO_2$ (powder resistivity: 800 Ωcm; coverage of $SnO_2$ in mass percentage: 65%).

The $TiO_2$ particles coated with oxygen deficient $SnO_2$ in this conductive layer coating fluid had an average particle diameter of 0.57 μm. In the particles, particles having particle diameters in the range of from 0.10 μm to 0.40 μm were in a proportion of 33.8 mass %.

Preparation of Conductive Layer Coating Fluid K

Conductive Layer Coating Fluid K was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 57.6 parts of $TiO_2$ particles coated with oxygen deficient $SnO_2$ (powder resistivity: 0.8 Ωcm; coverage of $SnO_2$ in mass percentage: 70%) and also that the amount of the phenol resin used as the binder resin of the conductive layer was changed to 32 parts and the dispersion time was changed to 0.5 hour.

Conductive Layer Coating Fluid K and Conductive Layer Coating Fluid F were also placed together in a mass ratio of 3:2, followed by mixing for 2 hours by means of a roll counter to prepare Conductive Layer Coating Fluid J.

The $TiO_2$ particles coated with oxygen deficient $SnO_2$ in Conductive Layer Coating Fluid K had an average particle diameter of 0.57 μm. In the particles, particles having particle diameters in the range of from 0.10 μm to 0.40 μm were in a proportion of 46.2% by mass.

Preparation of Conductive Layer Coating Fluid L

Conductive Layer Coating Fluid L was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 53 parts of the same $TiO_2$ particles coated with oxygen deficient $SnO_2$ and that the amount of the phenol resin used as the binder resin of the conductive layer was changed to 40 parts.

The $TiO_2$ particles coated with oxygen deficient $SnO_2$ in this conductive layer coating fluid had an average particle diameter of 0.36 μm. In the particles, particles having particle diameters in the range of from 0.10 μm to 0.40 μm were in a proportion of 62.5 mass %.

Preparation of Conductive Layer Coating Fluid M

Conductive Layer Coating Fluid M was prepared in the same manner as Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 56.7 parts of the same $TiO_2$ particles coated with oxygen deficient $SnO_2$ and that the amount of the phenol resin used as the binder resin of the conductive layer was changed to 33.5 parts.

The $TiO_2$ particles coated with oxygen deficient $SnO_2$ in this conductive layer coating fluid had an average particle diameter of 0.36 μm. Of the particles, the particles having particle diameters in the range of from 0.10 μm to 0.40 μm were in a proportion of 61.8 mass %.

Preparation of Conductive Layer Coating Fluid N

Conductive Layer Coating Fluid N was prepared in the same manner as Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 58.5 parts of the same $TiO_2$ particles coated with oxygen deficient $SnO_2$ and that the amount of the phenol resin used as the binder resin of the conductive layer was changed to 30.5 parts.

The $TiO_2$ particles coated with oxygen deficient $SnO_2$ in this conductive layer coating fluid had an average particle diameter of 0.36 μm. In the particles, particles having particle diameters in the range of from 0.10 μm to 0.40 μm were in a proportion of 60.9 mass %.

Preparation of Conductive Layer Coating Fluid P

Conductive Layer Coating Fluid P was prepared in the same manner as Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 59.4 parts of the same $TiO_2$ particles coated with oxygen deficient $SnO_2$ and that the amount of the phenol resin used as the binder resin of the conductive layer was changed to 17.4 parts.

The $TiO_2$ particles coated with oxygen deficient $SnO_2$ in this conductive layer coating fluid had an average particle diameter of 0.36 μm. In the particles, particles having particle diameters in the range of from 0.10 μm to 0.40 μm were in a proportion of 60.3 mass %.

Preparation of Conductive Layer Coating Fluid Q

Conductive Layer Coating Fluid Q was prepared in the same manner as in Conductive Layer Coating Fluid A except that the binder resin was changed to 31.3 parts of polyester polyurethane (trade name: NIPPOLAN 2304; available from Nippon Polyurethane Industry Co., Ltd.; solid content: 70%).

The $TiO_2$ particles coated with oxygen deficient $SnO_2$ in this conductive layer coating fluid had an average particle diameter of 0.36 μm. In the particles, particles having particle diameters in the range of from 0.10 μm to 0.40 μm were in a proportion of 61.1 mass %.

Preparation of Conductive Layer Coating Fluid R

Conductive Layer Coating Fluid R was prepared in the same manner as in Conductive Layer Coating Fluid A except that the amount of the silicone resin particles used as the surface roughness providing material of the conductive layer was changed to 3.3 parts.

The $TiO_2$ particles coated with oxygen deficient $SnO_2$ in this conductive layer coating fluid had an average particle diameter of 0.36 μm. In the particles, particles having particle diameters in the range of from 0.10 μm to 0.40 μm were in a proportion of 60.3 mass %.

Preparation of Conductive Layer Coating Fluid S

Conductive Layer Coating Fluid S was prepared in the same manner as in Conductive Layer Coating Fluid A except that the amount of the silicone resin particles used as the surface roughness providing material of the conductive layer was changed to 4.4 parts.

The $TiO_2$ particles coated with oxygen deficient $SnO_2$ in this conductive layer coating fluid were in an average particle diameter of 0.36 μm. In the particles, particles having particle diameters in the range of from 0.10 μm to 0.40 μm were in a proportion of 60.3 mass %.

Preparation of Conductive Layer Coating Fluid T

Conductive Layer Coating Fluid T was prepared in the same manner as in Conductive Layer Coating Fluid A except that the amount of the silicone resin particles used as the surface roughness providing material of the conductive layer was changed to 5.4 parts.

The $TiO_2$ particles coated with oxygen deficient $SnO_2$ in this conductive layer coating fluid had an average particle diameter of 0.36 μm. In the particles, particles having particle diameters in the range of from 0.10 μm to 0.40 μm were in a proportion of 60.3 mass %.

Preparation of Conductive Layer Coating Fluid a

Conductive Layer Coating Fluid a was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 57.6 parts of $TiO_2$ particles coated with oxygen deficient $SnO_2$ (powder resistivity: 0.8 Ωcm; coverage of $SnO_2$ in mass percentage: 70%) and also that the amount of the phenol resin used as the binder resin of the conductive layer was changed to 32 parts.

The $TiO_2$ particles coated with oxygen deficient $SnO_2$ in this conductive layer coating fluid had an average particle diameter of 0.65 μm. In the particles, particles having particle diameter in the range of from 0.10 μm to 0.40 μm were in a proportion of 22.5 mass %.

Preparation of Conductive Layer Coating Fluid b

Conductive Layer Coating Fluid b was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 51.2 parts of $TiO_2$ particles coated with oxygen deficient $SnO_2$ (powder resistivity: 120 Ωcm; coverage of $SnO_2$ in mass percentage: 40%) and also that the amount of the phenol resin used as the binder resin of the conductive layer was changed to 42.6 parts.

The $TiO_2$ particles coated with oxygen deficient $SnO_2$ in this conductive layer coating fluid had an average particle diameter of 0.35 μm. In the particles, particles having particle diameter in the range of from 0.10 μm to 0.40 μm were in a proportion of 63.9 mass %.

Preparation of Conductive Layer Coating Fluid c

Conductive Layer Coating Fluid c was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 58.9 parts of $TiO_2$ particles coated with oxygen deficient $SnO_2$ (powder resistivity: 1,200 Ωcm; coverage of $SnO_2$ in mass percentage: 20%) and also that the amount of the phenol resin used as the binder resin of the conductive layer was changed to 29.8 parts.

The $TiO_2$ particles coated with oxygen deficient $SnO_2$ in this conductive layer coating fluid had an average particle diameter of 0.19 μm. In the particles, particles having particle diameter in the range of from 0.10 μm to 0.40 μm were in a proportion of 88.1 mass %.

Preparation of Conductive Layer Coating Fluid d

Conductive Layer Coating Fluid d was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of $TiO_2$ particles coated with $SnO_2$ doped with 10 mass % of antimony oxide (powder resistivity: 15 Ωcm; coverage of $SnO_2$ in mass percentage: 40%).

The $TiO_2$ particles coated with $SnO_2$ doped with 10 mass % of antimony oxide in this conductive layer coating fluid had an average particle diameter of 0.36 μm. In the particles, the particles having particle diameter in the range of from 0.10 μm to 0.40 μm were in a proportion of 61.0 mass %.

Preparation of Conductive Layer Coating Fluid e

Conductive Layer Coating Fluid e was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of barium sulfate particles coated with oxygen deficient $SnO_2$ (powder resistivity: 950 Ωcm; coverage of $SnO_2$ in mass percentage: 30%).

The barium sulfate particles coated with oxygen deficient $SnO_2$ in this conductive layer coating fluid had an average particle diameter of 0.18 μm. In the particles, particles having particle diameter in the range of from 0.10 μm to 0.40 μm were in a proportion of 85.2 mass %.

Preparation of Conductive Layer Coating Fluid f

Conductive Layer Coating Fluid f was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of $TiO_2$ particles coated with $SnO_2$ having been subjected to neither doping treatment nor oxygen deficient treatment (powder resistivity: 200,000 Ωcm; coverage of $SnO_2$ in mass percentage: 40%).

The $TiO_2$ particles coated with $SnO_2$ having been subjected to neither doping treatment nor oxygen deficient treatment, in this conductive layer coating fluid had an average particle diameter of 0.34 μm. In the particles, particles having particle diameter in the range of from 0.10 μm to 0.40 μm were in a proportion of 64.8 mass %.

Preparation of Conductive Layer Coating Fluid g

Conductive Layer Coating Fluid g was prepared in the same manner as in Conductive Layer Coating Fluid A except that 55 parts of the $TiO_2$ particles coated with oxygen deficient $SnO_2$ (powder resistivity: 100 Ωcm; coverage of $SnO_2$ in mass percentage: 40%) were changed to 55 parts of oxygen deficient $SnO_2$ particles (powder resistivity: 0.5 Ωcm; no core particles).

The oxygen deficient $SnO_2$ particles in this conductive layer coating fluid had an average particle diameter of 0.05 μm. In the particles, particles having particle diameter in the range of from 0.10 μm to 0.40 μm were in a proportion of 40.0 mass %.

Electrophotographic Photosensitive Member Production

Examples

Production of Electrophotographic Photosensitive Member 1

An aluminum cylinder (JIS A 3003, aluminum alloy) of 260.5 mm in length and 30 mm in diameter which was produced by a production process having the step of extrusion and the step of drawing was used as a support.

Conductive Layer Coating Fluid A was applied by dip coating on the support in a 23° C./60% RH environment, followed by drying and heat curing at 140° C. for 30 minutes to form a conductive layer with a layer thickness of 15 μm. The Rz jis of the surface of the conductive layer was measured to find that it was 1.5 μm.

(In the present invention, the Rz jis was measured according to JIS B 0601 (1994) by using a surface profile analyzer SURFCORDER SE3500, manufactured by Kosaka Laboratory Ltd., and setting feed speed at 0.1 mm/s, cut-off λc at 0.8 mm, and measurement length at 2.50 mm.).

A conductive layer sample (layer thickness: 15 μm) was prepared using the Conductive Layer Coating Fluid A. A thin film of gold was formed on this conductive layer sample by vacuum deposition, and the volume resistivity of the conductive layer was measured to find that it was $1.5\times10^{10}$ Ωcm.

Next, 4.5 parts of N-methoxymethylated nylon (trade name: TORESIN EF-30T; available from Teikoku Chemical Industry Co., Ltd.) and 1.5 parts of copolymer nylon resin (trade name: AMILAN CM8000; available from Toray Industries, Inc.) were dissolved in a mixed solvent of 65 parts of methanol and 30 parts of n-butanol to prepare an intermediate layer coating fluid. The intermediate layer coating fluid obtained was applied by dip coating on the conductive layer, followed by drying at 100° C. for 10 minutes to form an intermediate layer with a layer thickness of 0.6 μm.

An intermediate layer sample (layer thickness: 3 μm) was prepared using this intermediate layer coating fluid. A thin film of gold was formed on this intermediate layer sample by vacuum deposition, and the volume resistivity of the intermediate layer was measured to find that it was $2.0\times10^{11}$ Ωm.

A conductive layer and intermediate layer multi-layer sample (layer thickness of conductive layer: 15 μm; layer thickness of intermediate layer: 0.6 μm) was prepared using the above conductive layer coating fluid and intermediate layer coating fluid. A thin film of gold was formed on this multi-layer sample by vacuum deposition, and the Imin/I(0) was measured to find that it was 0.80.

Next, 10 parts of hydroxygallium phthalocyanine with a crystal form having strong peaks at Bragg angles 2θ±0.2° of 7.5°, 9.9°, 16.3°, 18.6°, 25.1° and 28.3° in CuKα characteristic X-ray diffraction, 5 parts of polyvinyl butyral (trade name: S-LEC BX-1, available from Sekisui Chemical Co., Ltd.) and 250 parts of cyclohexanone were subjected to dispersion for 1 hour by means of a sand mill making use of glass beads of 1 mm in diameter, and then 250 parts of ethyl acetate was added to prepare a charge generation layer coating fluid.

This charge generation layer coating fluid was applied by dip coating on the intermediate layer, followed by drying at 100° C. for 10 minutes to form a charge generation layer with a layer thickness of 0.16 μm.

Next, 10 parts of an amine compound having a structure represented by the following formula:

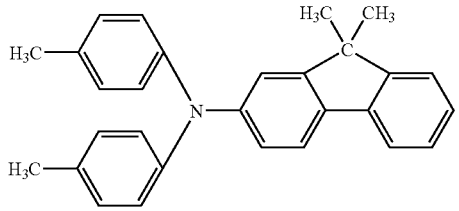

and 10 parts of polycarbonate resin (trade name: Z400; available from Mitsubishi Engineering-Plastics Corporation) were dissolved in a mixed solvent of 30 parts of dimethoxymethane and 70 parts of chlorobenzene to prepare a charge transport layer coating fluid.

This charge transport layer coating fluid was applied by dip coating on the charge generation layer, followed by drying at 120° C. for 30 minutes to form a charge transport layer with a layer thickness of 18 μm.

Thus, Electrophotographic Photosensitive Member 1 was produced in which the charge transport layer was a surface layer.

Production of Electrophotographic Photosensitive Member 2

Electrophotographic Photosensitive Member 2 was produced in the same manner as in the production of Electrophotographic Photosensitive Member 1 except that Conductive Layer Coating Fluid A was changed to Conductive Layer Coating Fluid B.

As a result, the Rz jis of the surface of the conductive layer was 1.3 μm, the volume resistivity of the conductive layer was $4.4\times10^{10}$ Ωcm, and the Imin/I(0) in the conductive layer and intermediate layer multi-layer sample was 0.50.

Production of Electrophotographic Photosensitive Member 3

Electrophotographic Photosensitive Member 3 was produced in the same manner as in the production of Electrophotographic Photosensitive Member 1 except that Conductive Layer Coating Fluid A was changed to Conductive Layer Coating Fluid C.

As a result, the Rz jis of the surface of the conductive layer was 1.7 μm, the volume resistivity of the conductive layer was $7.5\times10^{9}$ Ωcm, and the Imin/I(0) in the conductive layer and intermediate layer multi-layer sample was 1.00.

Production of Electrophotographic Photosensitive Member 4

Electrophotographic Photosensitive Member 4 was produced in the same manner as in the production of Electrophotographic Photosensitive Member 1 except that Conductive Layer Coating Fluid A was changed to Conductive Layer Coating Fluid D.

As a result, the Rz jis of the surface of the conductive layer was 1.3 μm, the volume resistivity of the conductive layer was $1.1\times10^{11}$ Ωcm, and the Imin/I(0) in the conductive layer and intermediate layer multi-layer sample was 0.50.

Production of Electrophotographic Photosensitive Member 5

Electrophotographic Photosensitive Member 5 was produced in the same manner as in the production of Electrophotographic Photosensitive Member 1 except that Conductive Layer Coating Fluid A was changed to Conductive Layer Coating Fluid E.

As a result, the Rz jis of the surface of the conductive layer was 1.5 μm, the volume resistivity of the conductive layer was $1.5\times10^{10}$ Ωcm, and the Imin/I(0) in the conductive layer and intermediate layer multi-layer sample was 0.53.

Production of Electrophotographic Photosensitive Member 6

Electrophotographic Photosensitive Member 6 was produced in the same manner as in the production of Electrophotographic Photosensitive Member 1 except that Conductive Layer Coating Fluid A was changed to Conductive Layer Coating Fluid F.

As the result, the Rz jis of the surface of the conductive layer was 1.1 μm, the volume resistivity of the conductive layer was $1.0\times10^{11}$ Ωcm, and the Imin/I(0) in the conductive layer and intermediate layer multi-layer sample was 0.33.

Production of Electrophotographic Photosensitive Member 7

Electrophotographic Photosensitive Member 7 was produced in the same manner as in the production of Electrophotographic Photosensitive Member 1 except that Conductive Layer Coating Fluid A was changed to Conductive Layer Coating Fluid G.

As a result, the Rz jis of the surface of the conductive layer was 1.7 μm, the volume resistivity of the conductive layer was $2.5\times10^{9}$ Ωcm, and the Imin/I(0) in the conductive layer and intermediate layer multi-layer sample was 1.00.

Production of Electrophotographic Photosensitive Member 8

Electrophotographic Photosensitive Member 8 was produced in the same manner as in the production of Electrophotographic Photosensitive Member 1 except that Conductive Layer Coating Fluid A was changed to Conductive Layer Coating Fluid H.

As the result, the Rz jis of the surface of the conductive layer was 2.0 μm, the volume resistivity of the conductive layer was $1.5\times10^{9}$ Ωcm, and the Imin/I(0) in the conductive layer and intermediate layer multi-layer sample was 0.96.

Production of Electrophotographic Photosensitive Member 9

Electrophotographic Photosensitive Member 9 was produced in the same manner as in the production of Electrophotographic Photosensitive Member 1 except that Conductive Layer Coating Fluid A was changed to Conductive Layer Coating Fluid I.

As a result, the Rz jis of the surface of the conductive layer was 2.2 μm, the volume resistivity of the conductive layer was $1.0\times10^{9}$ Ωcm, and the Imin/I(0) in the conductive layer and intermediate layer multi-layer sample was 1.00.

Production of Electrophotographic Photosensitive Member 10

Electrophotographic Photosensitive Member 10 was produced in the same manner as in the production of Electrophotographic Photosensitive Member 1 except that Conductive Layer Coating Fluid A was changed to Conductive Layer Coating Fluid K.

As a result, the Rz jis of the surface of the conductive layer was 1.8 μm, the volume resistivity of the conductive layer was $1.2\times10^{9}$ Ωcm, and the Imin/I(0) in the conductive layer and intermediate layer multi-layer sample was 0.88.

Production of Electrophotographic Photosensitive Member 11

Electrophotographic Photosensitive Member 11 was produced in the same manner as in the production of Electrophotographic Photosensitive Member 1 except that Conductive Layer Coating Fluid A was changed to Conductive Layer Coating Fluid L.

As a result, the Rz jis of the surface of the conductive layer was 1.6 μm, the volume resistivity of the conductive layer was $5.0\times10^{10}$ Ωcm, and the Imin/I(0) in the conductive layer and intermediate layer multi-layer sample was 0.20.

Production of Electrophotographic Photosensitive Member 12

Electrophotographic Photosensitive Member 12 was produced in the same manner as in the production of Electrophotographic Photosensitive Member 1 except that Conductive Layer Coating Fluid A was changed to Conductive Layer Coating Fluid M.

As a result, the Rz jis of the surface of the conductive layer was 1.5 μm, the volume resistivity of the conductive layer was $4.5\times10^{9}$ Ωcm, and the Imin/I(0) in the conductive layer and intermediate layer multi-layer sample was 0.86.

Production of Electrophotographic Photosensitive Member 13

Electrophotographic Photosensitive Member 13 was produced in the same manner as in the production of Electrophotographic Photosensitive Member 1 except that Conductive Layer Coating Fluid A was changed to Conductive Layer Coating Fluid N.

As a result, the Rz jis of the surface of the conductive layer was 1.4 μm, the volume resistivity of the conductive layer was $1.5\times10^{9}$ Ωcm, and the Imin/I(0) in the conductive layer and intermediate layer multi-layer sample was 0.90.

Production of Electrophotographic Photosensitive Member 14

Electrophotographic Photosensitive Member 14 was produced in the same manner as in the production of Electrophotographic Photosensitive Member 1 except that Conductive Layer Coating Fluid A was changed to Conductive Layer Coating Fluid P.

As the result, the Rz jis of the surface of the conductive layer was 1.3 μm, the volume resistivity of the conductive layer was $8.5\times10^{8}$ Ωcm, and the Imin/I(0) in the conductive layer and intermediate layer multi-layer sample was 0.91.

Production of Electrophotographic Photosensitive Member 15

Electrophotographic Photosensitive Member 15 was produced in the same manner as in the production of Electrophotographic Photosensitive Member 1 except that the layer thickness of the conductive layer was changed to 9 μm.

As a result, the Rz jis of the surface of the conductive layer was 1.2 μm, the volume resistivity of the conductive layer was $8.5\times10^{8}$ Ωcm, and the Imin/I(O) in the conductive layer and intermediate layer multi-layer sample was 0.91.

Production of Electrophotographic Photosensitive Member 16

Electrophotographic Photosensitive Member 16 was produced in the same manner as in the production of Electrophotographic Photosensitive Member 1 except that the layer thickness of the conductive layer was changed to 10 μm.

As a result, the Rz jis of the surface of the conductive layer was 1.3 μm, the volume resistivity of the conductive layer was $8.5\times10^{8}$ Ωcm, and the Imin/I(O) in the conductive layer and intermediate layer multi-layer sample was 0.91.

Production of Electrophotographic Photosensitive Member 17

Electrophotographic Photosensitive Member 17 was produced in the same manner as in the production of Electrophotographic Photosensitive Member 1 except that the layer thickness of the conductive layer was changed to 20 μm.

As a result, the Rz jis of the surface of the conductive layer was 1.7 μm, the volume resistivity of the conductive layer was $8.5\times10^{8}$ Ωcm, and the Imin/I(O) in the conductive layer and intermediate layer multi-layer sample was 0.91.

Production of Electrophotographic Photosensitive Member 18

Electrophotographic Photosensitive Member 18 was produced in the same manner as in the production of Electrophotographic Photosensitive Member 1 except that the layer thickness of the conductive layer was changed to 25 μm.

As a result, the Rz jis of the surface of the conductive layer was 2.3 μm, the volume resistivity of the conductive layer was $8.5\times10^{8}$ Ωcm, and the Imin/I(0) in the conductive layer and intermediate layer multi-layer sample was 0.91.

Production of Electrophotographic Photosensitive Member 19

Electrophotographic Photosensitive Member 19 was produced in the same manner as in the production of Electrophotographic Photosensitive Member 1 except that the layer thickness of the conductive layer was changed to 28 μm.

As a result, the Rz jis of the surface of the conductive layer was 2.5 μm, the volume resistivity of the conductive layer was $8.5\times10^{8}$ Ωcm, and the Imin/I(0) in the conductive layer and intermediate layer multi-layer sample was 0.91.

Production of Electrophotographic Photosensitive Member 20

Electrophotographic Photosensitive Member 20 was produced in the same manner as in the production of Electrophotographic Photosensitive Member 1 except that Conductive Layer Coating Fluid A was changed to Conductive Layer Coating Fluid Q and the layer thickness of the conductive layer was changed to 10 μm.

As a result, the Rz jis of the surface of the conductive layer was 1.3 μm, the volume resistivity of the conductive layer was $3.0\times10^{10}$ Ωcm, and the Imin/I(0) in the conductive layer and intermediate layer multi-layer sample was 0.70.

Production of Electrophotographic Photosensitive Member 21

Electrophotographic Photosensitive Member 21 was produced in the same manner as in the production of Electrophotographic Photosensitive Member 1 except that Conductive Layer Coating Fluid A was changed to Conductive Layer Coating Fluid R.

As a result, the Rz jis of the surface of the conductive layer was 1.2 μm, the volume resistivity of the conductive layer was $1.5\times10^{10}$ Ωcm, and the Imin/I(0) in the conductive layer and intermediate layer multi-layer sample was 0.80.

Production of Electrophotographic Photosensitive Member 22

Electrophotographic Photosensitive Member 22 was produced in the same manner as the production of Electrophotographic Photosensitive Member 1 except that Conductive Layer Coating Fluid A was changed to Conductive Layer Coating Fluid S.

As the result, the Rz jis of the surface of the conductive layer was 1.8 μm, the volume resistivity of the conductive layer was $1.5\times10^{10}$ Ωcm, and the Imin/I(0) in the conductive layer and intermediate layer multi-layer sample was 0.80.

Production of Electrophotographic Photosensitive Member 23

Electrophotographic Photosensitive Member 23 was produced in the same manner as in the production of Electrophotographic Photosensitive Member 1 except that Conductive Layer Coating Fluid A was changed for Conductive Layer Coating Fluid T.

As a result, the Rz jis of the surface of the conductive layer was 2.1 μm, the volume resistivity of the conductive layer was $1.5\times10^{10}$ Ωcm, and the Imin/I(0) in the conductive layer and intermediate layer multi-layer sample was 0.80.

Production of Electrophotographic Photosensitive Member 24

Electrophotographic Photosensitive Member 24 was produced in the same manner as the production of Electrophotographic Photosensitive Member 1 except that the layer thickness of the intermediate layer was changed to 0.4 μm.

As a result, the Rz jis of the surface of the conductive layer was 1.5 μm, the volume resistivity of the conductive layer was $1.5\times10^{10}$ Ωcm, and the Imin/I(0) in the conductive layer and intermediate layer multi-layer sample was 0.80.

Production of Electrophotographic Photosensitive Member 25

Electrophotographic Photosensitive Member 25 was produced in the same manner as the production of Electrophotographic Photosensitive Member 1 except that the layer thickness of the intermediate layer was changed to 1.5 μm.

As a result, the Rz jis of the surface of the conductive layer was 1.5 μm, the volume resistivity of the conductive layer was $1.5\times10^{10}$ Ωcm, and the Imin/I(0) in the conductive layer and intermediate layer multi-layer sample was 0.80.

Production of Electrophotographic Photosensitive Member 26

Electrophotographic Photosensitive Member 26 was produced in the same manner as the production of Electrophotographic Photosensitive Member 1 except that the layer thickness of the charge transport layer was changed to 20 μm.

As a result, the Rz jis of the surface of the conductive layer was 1.5 μm, the volume resistivity of the conductive layer was $1.5\times10^{10}$ Ωcm, and the Imin/I(0) in the conductive layer and intermediate layer multi-layer sample was 0.80.

Production of Electrophotographic Photosensitive Member 27

Electrophotographic Photosensitive Member 27 was produced in the same manner as the production of Electrophotographic Photosensitive Member 1 except that the layer thickness of the charge transport layer was changed to 10 μm.

As a result, the Rz jis of the surface of the conductive layer was 1.5 μm, the volume resistivity of the conductive layer was $1.5\times10^{10}$ Ωcm, and the Imin/I(0) in the conductive layer and intermediate layer multi-layer sample was 0.80.

Production of Electrophotographic Photosensitive Member 28

Electrophotographic Photosensitive Member 28 was produced in the same manner as in Example 1 except that in the production of Electrophotographic Photosensitive Member 1, the binder resin of the charge transport layer was changed to polyarylate resin having a repeating structural unit represented by the following formula:

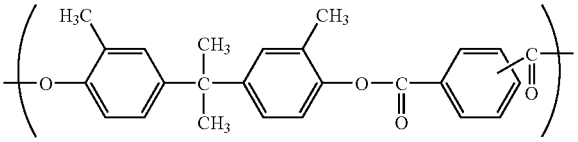

(viscosity average molecular weight Mv: 42,000). In addition, the polyarylate resin having a repeating structural unit represented by the above formula is a resin in which the molar ratio of the terephthalic acid structure to the isophthalic acid structure (terephthalic acid structure:isophthalic acid structure) was 50:50.

In addition, the viscosity average molecular weight Mv was measured in the following way.

First, 0.5 g of a sample was dissolved in 100 ml of methylene chloride, and the specific viscosity at 25° C. of the resulting solution was measured with an improved Ubbelohde type viscometer. Next, the intrinsic viscosity was determined from this specific viscosity, and the viscosity average molecular weight Mv was calculated according to the Mark-Houwink's viscosity equation. The viscosity average molecular weight Mv was obtained as the value in terms of polystyrene that was measured by GPC (gel permeation chromatography).

As a result, the Rz jis of the surface of the conductive layer was 1.5 μm, the volume resistivity of the conductive layer was $1.5\times10^{10}$ Ωcm, and the Imin/I(0) in the conductive layer and intermediate layer multi-layer sample was 0.80.

Production of Electrophotographic Photosensitive Member a

Electrophotographic Photosensitive Member a was produced in the same manner as in the production of Electrophotographic Photosensitive Member 1 except that Conductive Layer Coating Fluid A was changed to Conductive Layer Coating Fluid a.

As a result, the Rz jis of the surface of the conductive layer was 1.4 μm, the volume resistivity of the conductive layer was $6.0\times10^{8}$ Ωcm, and the Imin/I(0) in the conductive layer and intermediate layer multi-layer sample was 1.00.

Production of Electrophotographic Photosensitive Member b

Electrophotographic Photosensitive Member b was produced in the same manner as in the production of Electrophotographic Photosensitive Member 1 except that Conductive Layer Coating Fluid A was changed to Conductive Layer Coating Fluid b.

As a result, the Rz jis of the surface of the conductive layer was 1.2 μm, the volume resistivity of the conductive layer was $2.0\times10^{11}$ Ωcm, and the Imin/I(0) in the conductive layer and intermediate layer multi-layer sample was 0.17.

Production of Electrophotographic Photosensitive Member c

Electrophotographic Photosensitive Member c was produced in the same manner as in the production of Electrophotographic Photosensitive Member 1 except that Conductive Layer Coating Fluid A was changed to Conductive Layer Coating Fluid c.

As a result, the Rz jis of the surface of the conductive layer was 0.8 μm, the volume resistivity of the conductive layer was $7.0\times10^{10}$ Ωcm, and the Imin/I(0) in the conductive layer and intermediate layer multi-layer sample was 0.18.

Production of Electrophotographic Photosensitive Member d

Electrophotographic Photosensitive Member d was produced in the same manner as in the production of Electrophotographic Photosensitive Member 1 except that Conductive Layer Coating Fluid A was changed to Conductive Layer Coating Fluid d.

As a result, the Rz jis of the surface of the conductive layer was 1.6 μm, the volume resistivity of the conductive layer was $4.0\times10^{8}$ Ωcm, and the Imin/I(O) in the conductive layer and intermediate layer multi-layer sample was 0.67.

Production of Electrophotographic Photosensitive Member e

Electrophotographic Photosensitive Member e was produced in the same manner as in the production of Electrophotographic Photosensitive Member 1 except that Conductive Layer Coating Fluid A was changed to Conductive Layer Coating Fluid e.

As a result, the Rz jis of the surface of the conductive layer was 0.9 μm, the volume resistivity of the conductive layer was $3.0\times10^{11}$ Ωcm, and the Imin/I(0) in the conductive layer and intermediate layer multi-layer sample was 0.40.

Production of Electrophotographic Photosensitive Member f

Electrophotographic Photosensitive Member f was produced in the same manner as in the production of Electrophotographic Photosensitive Member 1 except that Conductive Layer Coating Fluid A was changed to Conductive Layer Coating Fluid f.

As a result, the Rz jis of the surface of the conductive layer was 1.5 μm, the volume resistivity of the conductive layer was $5.0\times10^{12}$ Ωcm, and the Imin/I(0) in the conductive layer and intermediate layer multi-layer sample was 0.10.

Production of Electrophotographic Photosensitive Member g

Electrophotographic Photosensitive Member g was produced in the same manner as the production of Electrophotographic Photosensitive Member 1 except that Conductive Layer Coating Fluid A was changed to Conductive Layer Coating Fluid g.

As a result, the Rz jis of the surface of the conductive layer was 1.6 μm, the volume resistivity of the conductive layer was $7.0\times10^{11}$ Ωcm, and the Imin/I(0) in the conductive layer and intermediate layer multi-layer sample was 0.14.

Production of Electrophotographic Photosensitive Member h

Electrophotographic Photosensitive Member h was produced in the same manner as in the production of Electrophotographic Photosensitive Member 1 except that the intermediate layer was not provided.

As a result, the Rz jis of the surface of the conductive layer was 1.5 μm, and the volume resistivity of the conductive layer was $1.5\times10^{10}$ Ωcm.

Charging Member Production Examples

Production of Charging Roller A

First, an elastic layer was formed in the following way.

| | |
|---|---|
| Epichlorohydrin rubber terpolymer (epichlorohydrin:ethylene oxide:allyl glycidyl ether = 40 mol %:56 mol %:4 mol %) | 100 parts |
| Soft calcium carbonate | 30 parts |
| Aliphatic polyester type plasticizer | 5 parts |
| Zinc stearate | 1 part |
| Antioxidant MB (2-mercaptobenzimidazole) | 0.5 part |
| Zinc oxide | 5 parts |

-continued

| | |
|---|---|
| Quaternary ammonium salt (the following structural formula) | 2 parts |

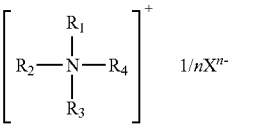

$R_1 = CH_3(CH_2)_6CH_2$
$R_2 = CH_3$
$R_3 = CH_3$
$R_4 = CH_2CH_2OH$
$X = ClO_4$
$n = 1$

| | |
|---|---|
| Carbon black (surface-untreated product; average particle diameter: 0.2 μm; volume resistivity: 0.1 Ωcm) | 5 parts |

The above materials were kneaded for 10 minutes by means of a closed mixer adjusted to 50° C., to prepare a raw-material compound. To this compound, 1 part of sulfur as a vulcanizing agent, 1 part of DM (dibenzothiazyl sulfide) as a vulcanization accelerator and 0.5 part of TS (tetramethylthiuram monosulfide), based on 100 parts of the raw-material rubber epichlorohydrin rubber, were added and kneaded for 10 minutes by means of a two-roll mill cooled to 20° C.

The compound obtained by kneading was extruded by means of an extruder onto a mandrel of 6 mm in diameter made of stainless steel, and was so formed as to be in the shape of a roller of 15 mm in outer diameter. The extruded product was vulcanized with hot steam, and thereafter processed by abrasion so as to have an outer diameter of 10 mm, to thereby produce a roller having an elastic layer. In the abrasion processing, a wide abrasion method was employed. The roller length was 232 mm.

On the elastic layer, a surface layer was formed by applying a surface layer coating fluid shown below by dip-coating. The dip coating was carried out twice.

First, using the following materials as materials for the surface layer coating fluid, a fluid mixture was prepared in a glass bottle as a container.

| | |
|---|---|
| Caprolactone modified acrylic-polyol solution | 100 parts |
| Methyl isobutyl ketone | 250 parts |
| Conductive tin oxide (trifluoropropyltrimethoxysilane-treated product; average particle diameter: 0.05 μm; volume resistivity: $10^3$ Ωcm) | 130 parts |
| Hydrophobic silica (dimethylpolysiloxane-treated product; average particle diameter: 0.02 μm; volume resistivity: $10^{16}$ Ωcm) | 3 parts |
| Modified dimethylsilicone oil | 0.08 parts |
| Cross-linked PMMA particles (average particle diameter: 4.98 μm) | 80 parts |

In this container, glass beads (average particle diameter: 0.8 mm) as a dispersing medium were so filled as to be in a fill of 80%, carrying out dispersion for 18 hours by means of a paint shaker dispersion machine. To the fluid dispersion obtained, a 1:1 mixture of butanone oxime blocked substances of hexamethylene diisocyanate (HDI) and isophorone diisocyanate (IPDI) each was so added as to be

NCO/OH=1.0 to prepare the surface layer coating fluid for dip coating.

The surface layer coating fluid was coated twice on the elastic layer by dip coating, followed by air drying, and thereafter drying at a temperature of 160° C. for 1 hour to produce Charging Roller A.

In Charging Roller A thus produced, its ten-point average roughness (Rz jis) was measured by the method described previously, and found to be 4.4 μm.

In addition, the particle size distribution of fine particles to be added to the surface layer was measured with a laser diffraction particle size distribution measuring instrument SALD-7000, manufactured by Shimadzu Corporation. The range of measurable particle diameter was from 0.015 to 500 μm.

Production of Charging Roller B

Charging Roller B was produced in the same manner as in the production of Charging Roller A except that the PMMA particles to be added to the surface layer were changed to those having an average particle diameter of 2.53 μm. Here, the Rz jis of Charging Roller B was 2.9 μm.

Production of Charging Roller C

Charging Roller C was produced in the same manner as in the production of Charging Roller A except that the PMMA particles to be added to the surface layer were changed to those having an average particle diameter of 1.09 μm. The Rz jis of Charging Roller C was 1.3 μm.

Production of Charging Roller D

Charging Roller D was produced in the same manner as the production of Charging Roller A except that the PMMA particles were not added to the surface layer. The Rz jis of Charging Roller D was 1.5 μm.

Examples 1 to 34

Comparative Examples 1 to 14

The electrophotographic photosensitive members and charging rollers produced as described above were each set in a modified machine of a laser beam printer LBP-2510, manufactured by CANON INC., and paper feed running (extensive operation) tests were conducted in an environment of 15° C./10% RH and an environment of 30° C./80% RH. Evaluation was made on images which were reproduced at the initial stage and after 5,000 sheets of paper were run. Details are as follows:

LBP-2510 was so modified as to be operated at a process speed of 190 mm/s. Evaluation was made using this modified machine, in which each electrophotographic photosensitive member and each charging roller were set in a cyan color process cartridge of LBP-2510 and this process cartridge was set in a cyan process cartridge station.

During the paper feed running, full-color printing was carried out in an intermittent mode in which a character image with a print percentage of 2% was reproduced on one sheet at intervals of 20 seconds, using letter paper, to reproduce images on 5,000 sheets.

Then, samples for image evaluation were reproduced on three sheets (having respectively a solid white image, a solid black image, and a one-dot zigzag pattern halftone image) at the start of running and after 5,000 sheets of paper were run.

In addition, image evaluation was made on charging lines, interference fringes, spots and fog in the running test conducted in an environment of 15° C./10% RH, and was made on spots and fog in the running test conducted in an environment of 30° C./80% RH.

The criteria of the image evaluation are as show below.

Charging Lines:

Whether or not any charging lines were seen in the zigzag pattern halftone image was examined.

A: No charging line is seen at all.

B: Almost no charging lines are seen.

C: Charging lines are slightly seen.

D: Charging lines are seen.

E: Charging lines are clearly seen.

Interference Fringes:

Whether or not any interference fringes were seen in the zigzag pattern halftone image was examined.

A: No interference fringe is seen at all.

C: Interference fringes are slightly seen.

D: Interference fringes are seen.

Fog and Spots:

Fog and spots on the solid white image were examined.

The results are shown in Tables 1 and 2. In the tables, blanks mean that no fog and spot occurred.

TABLE 1

| | | | Image evaluation results | | | | |
|---|---|---|---|---|---|---|---|
| | | | 15° C., 10% RH | | | | |
| | | | Charging lines | | | | |
| Example: | Photo-sensitive member | Charging roller | Initial stage | After 5,000 sheets | Inter-ference fringes | Spots, fog and so on | 30° C., 80% RH Spots, fog and so on |
| 1 | 1 | A | A | A | A | | |
| 2 | 2 | A | A | A | A | | |
| 3 | 3 | A | A | A | A | | |
| 4 | 4 | A | A | B | A | Slight fog after running. | |
| 5 | 5 | A | A | A | A | | |
| 6 | 6 | A | A | B | A | Slight fog after running. | |
| 7 | 7 | A | A | A | A | | |
| 8 | 8 | A | A | A | A | | |
| 9 | 9 | A | A | A | A | Slight black spots from initial stage up to after running. | Slight black spots from initial stage up to after running. |
| 10 | 10 | A | A | A | A | | |
| 11 | 11 | A | A | B | A | Slight fog after running. | |
| 12 | 12 | A | A | A | A | | |
| 13 | 13 | A | A | A | A | | Black spots at initial stage. |
| 14 | 14 | A | A | A | A | Lines due to cracking, from initial stage up to after running. | Lines due to cracking, from initial stage up to after running. |
| 15 | 15 | A | A | A | A | Slight black spots. | Slight black spots. |
| 16 | 16 | A | A | A | A | | |
| 17 | 17 | A | A | A | A | | Slight fog after running. |
| 18 | 18 | A | A | A | A | | |
| 19 | 19 | A | A | A | A | Lines due to cracking, from initial stage up to after running. | Lines due to cracking, from initial stage up to after running. |
| 20 | 20 | A | A | A | A | | |
| 21 | 21 | A | A | A | A | | |
| 22 | 22 | A | A | A | A | | |
| 23 | 23 | A | A | A | A | | |
| 24 | 24 | A | A | A | A | | Slight fog after running. |
| 25 | 25 | A | A | A | A | | |
| 26 | 26 | A | A | B | A | | |
| 27 | 27 | A | A | A | A | Slight fog at initial stage. | |
| 28 | 28 | A | A | A | A | | |
| 29 | 1 | B | A | A | A | | |
| 30 | 4 | B | A | B | A | Slight fog after running. | |
| 31 | 1 | C | A | A | A | | |
| 32 | 4 | C | A | B | A | Slight fog after running. | |
| 33 | 1 | D | A | A | A | | |
| 34 | 4 | D | A | B | A | Slight fog after running. | |

TABLE 2

| | | | Image evaluation results | | | | |
|---|---|---|---|---|---|---|---|
| | | | 15° C., 10% RH | | | | |
| | | | Charging lines | | | | |
| Comparative Example: | Photo-sensitive member | Charging roller | Initial stage | After 5,000 sheets | Inter-ference fringes | Spots, fog and so on | 30° C., 80% RH Spots, fog and so on |
| 1 | a | A | B | C | A | Black spots from initial stage up to after running. | Fog at initial stage. |
| 2 | b | A | C | D | A | | |
| 3 | c | A | A | B | C | | |
| 4 | d | A | A | C | A | | Fog from initial stage up to after running. |
| 5 | e | A | C | D | C | Fog after running. | |
| 6 | f | A | D | E | A | Fog after running. | |
| 7 | g | A | C | E | D | Fog after running. | |
| 8 | h | A | B | C | D | Black spots and fog from initial stage up to after running. | Black spots and fog from initial stage up to after running. |
| 9 | b | B | C | D | A | | |
| 10 | f | B | D | E | A | Fog after running. | |
| 11 | b | C | D | D | A | | |
| 12 | f | C | D | E | A | Fog after running. | |
| 13 | b | D | D | E | A | | |
| 14 | f | D | D | E | A | Fog after running. | |

As can be seen from the results shown above, according to the present invention, an electrophotographic photosensitive member in which the charging lines have been kept from occurring can be provided using the oxygen deficient $SnO_2$ having superior reuse properties, even when the electrophotographic photosensitive member is constituted to have a support, a conductive layer formed on the support an intermediate layer formed on the conductive layer and a photosensitive layer formed on the intermediate layer.

According to the present invention, a process cartridge and an electrophotographic apparatus can also be provided having such an electrophotographic photosensitive member.

According to the present invention, a process for producing such an electrophotographic apparatus can also be provided.

This application claims priority from Japanese Patent Application Nos. 2005-091564 filed on Mar. 28, 2005 and 2005-201857 filed on Jul. 11, 2005, which are hereby incorporated by reference herein.

The invention claimed is:

1. An electrophotographic photosensitive member which comprises a support, a conductive layer formed on the support, an intermediate layer formed on the conductive layer, and a photosensitive layer formed on the intermediate layer, wherein;

said conductive layer is a layer formed by using a conductive layer coating fluid which contains (a) $TiO_2$ particles coated with oxygen deficient $SnO_2$ (P) having an average particle diameter of from 0.20 μm or more to 0.60 μm or less and (b) a binding material (B), wherein a mass ratio of (P):(B) is from 2.3:1.0 to 3.3:1.0; and said conductive layer has a volume resistivity of from more than $8.0\times10^8$ Ωcm to $1.0\times10^{11}$ Ωcm or less.

2. The electrophotographic photosensitive member according to claim 1, wherein in the $TiO_2$ particles coated with oxygen deficient $SnO_2$ contained in the conductive layer coating fluid, $TiO_2$ particles coated with oxygen deficient $SnO_2$ of from 0.10 μm or more to 0.40 μm or less in particle diameter are in a proportion of 45% by number or more based on the number of all the $TiO_2$ particles coated with oxygen deficient $SnO_2$ contained in the conductive layer coating fluid.

3. The electrophotographic photosensitive member according to claim 1, wherein said conductive layer coating fluid is a coating fluid prepared by using $TiO_2$ particles coated with oxygen deficient $SnO_2$ having a powder resistivity of from 1 Ωcm or more to 500 Ωcm or less.

4. The electrophotographic photosensitive member according to claim 1, wherein said conductive layer has a layer thickness of from 10 μm or more to 25 μm or less.

5. The electrophotographic photosensitive member according to claim 1, wherein said binding material is at least one of a monomer and an oligomer of a raw material for a hardening resin.

6. The electrophotographic photosensitive member according to claim 1, wherein said support is a support made of aluminum and produced by a production process having a step of extrusion and a step of drawing.

7. A process cartridge which comprises the electrophotographic photosensitive member according to claim 1, and at least one selected from the group consisting of a charging means, a developing means, a transfer means and a cleaning means, which are integrally held; the process cartridge being detachably mountable to the main body of an electrophotographic apparatus.

8. The process cartridge according to claim 7, wherein said charging means comprises a charging member provided in contact with said electrophotographic photosensitive member.

9. The process cartridge according to claim 8, wherein said charging member is a member having a conductive support and a conductive cover layer formed on the conductive support, and the surface of the charging member has a ten-point average roughness Rz jis of 5 μm or less.

10. An electrophotographic apparatus which comprises the electrophotographic photosensitive member according to claim 1, a charging means, an exposure means, a developing means and a transfer means.

11. The electrophotographic apparatus according to claim 10, wherein said charging means comprises a charging member provided in contact with said electrophotographic photosensitive member.

12. The electrophotographic apparatus according to claim 11, wherein said charging member is a member having a conductive support and a conductive cover layer formed on the conductive support, and the surface of the charging member has a ten-point average roughness Rz jis of 5 μm or less.

13. The electrophotographic apparatus according to claim 11, which further comprises a voltage applying means for applying only a direct-current voltage.

14. A process for producing an electrophotographic photosensitive member; the process comprising a conductive layer forming step of forming on a support a conductive layer having a volume resistivity of from more than $8.0\times10^{8}$ Ωcm to $1.0\times10^{11}$ Ωcm or less, an intermediate layer forming step of forming an intermediate layer on the conductive layer, and a photosensitive layer forming step of forming a photosensitive layer on the intermediate layer;

in said conductive layer forming step, the layer being formed by using a conductive layer coating fluid which contains (a) $TiO_2$ particles coated with oxygen deficient $SnO_2$ (P) having an average particle diameter of from 0.20 μm or more to 0.60 μm or less and (b) a binding material (B), wherein a mass ratio of (P):(B) is from 2.3:1.0 to 3.3:1.0.

15. The process for producing an electrophotographic photosensitive member according to claim 14, wherein in the $TiO_2$ particles coated with oxygen deficient $SnO_2$ contained in the conductive layer coating fluid, $TiO_2$ particles coated with oxygen deficient $SnO_2$ of from 0.10 μm or more to 0.40 μm or less in particle diameter are in a proportion of 45% by number or more based on the number of all the $TiO_2$ particles coated with oxygen deficient $SnO_2$ contained in the conductive layer coating fluid.

16. The process for producing an electrophotographic photosensitive member according to claim 14, wherein said conductive layer coating fluid is a coating fluid prepared by using $TiO_2$ particles coated with oxygen deficient $SnO_2$ having a powder resistivity of from 1 Ωcm or more to 500 Ωcm or less.

17. The process for producing an electrophotographic photosensitive member according to claim 14, wherein said conductive layer is formed in a layer thickness of from 10 μm or more to 25 μm or less.

18. The process for producing an electrophotographic photosensitive member according to claim 14, wherein said binding material is at least one of a monomer and an oligomer of a raw material for a hardening resin.

19. The process for producing an electrophotographic photosensitive member according to claim 14, wherein said support is a support made of aluminum and produced by a production process having a step of extrusion and a step of drawing.

* * * * *